US009901240B2

(12) United States Patent
Lee

(10) Patent No.: US 9,901,240 B2
(45) Date of Patent: Feb. 27, 2018

(54) TINE ADJUSTMENT AND ADAPTABLE WASH CYCLE CONTROL

(71) Applicant: Samsung Electronics Co., Ltd., Suwon-si, Gyeonggi-do (KR)

(72) Inventor: Joon J. Lee, San Bruno, CA (US)

(73) Assignee: Samsung Electronics Co., Ltd., Suwon-si (KR)

( * ) Notice: Subject to any disclaimer, the term of this patent is extended or adjusted under 35 U.S.C. 154(b) by 584 days.

(21) Appl. No.: 14/458,552

(22) Filed: Aug. 13, 2014

(65) Prior Publication Data

US 2015/0053237 A1 Feb. 26, 2015

Related U.S. Application Data

(60) Provisional application No. 61/870,154, filed on Aug. 26, 2013, provisional application No. 61/878,279, filed on Sep. 16, 2013.

(51) Int. Cl.

*A47L 15/00* (2006.01)
*A47L 15/42* (2006.01)
*A47L 15/50* (2006.01)

(52) U.S. Cl.

CPC ..... *A47L 15/4295* (2013.01); *A47L 15/50* (2013.01); *A47L 15/503* (2013.01); *A47L 15/0021* (2013.01); *A47L 2301/06* (2013.01); *A47L 2401/04* (2013.01); *A47L 2501/03* (2013.01); *A47L 2501/04* (2013.01);

(Continued)

(58) Field of Classification Search

CPC ..... A47L 15/50; A47L 15/503; A47L 15/505; A47L 15/4295; A47L 2501/26

USPC ..... 134/58 R

See application file for complete search history.

(56) References Cited

U.S. PATENT DOCUMENTS 5,205,419 A 4/1993 Purtilo et al.
5,344,029 A 9/1994 Oghia
5,351,837 A 10/1994 Smith (Continued)

FOREIGN PATENT DOCUMENTS

CN 101014276 A 8/2007
CN 103547204 A 1/2014

(Continued)

OTHER PUBLICATIONS

Machine translation of EP 09621833 A1, dated Dec. 1999.*

(Continued)

*Primary Examiner* — Joseph L Perrin
*Assistant Examiner* — Kevin G Lee
(74) *Attorney, Agent, or Firm* — Sherman IP LLP; Kenneth L. Sherman; Hemavathy Perumal

(57) ABSTRACT

One embodiment provides a method for adapting a wash cycle of a dishwashing machine. The method comprises gathering sensor information from one or more sensors of the dishwashing machine. The sensor information gathered includes data identifying one or more adjustments to a rack layout of a dish rack of the dishwashing machine. The method further comprises determining a load configuration for the dish rack based on the sensor information gathered. The load configuration determined identifies one or more types of content loaded onto the dish rack. A wash cycle for washing the content loaded onto the dish rack is adapted based on the load configuration determined.

32 Claims, 25 Drawing Sheets

(52) U.S. Cl.
CPC ..... *A47L 2501/20* (2013.01); *A47L 2501/26* (2013.01); *A47L 2501/30* (2013.01)

(56) References Cited

U.S. PATENT DOCUMENTS

| | | | | |
|---|---|---|---|---|
| 6,138,693 | A | 10/2000 | Matz | |
| 6,666,220 | B2 * | 12/2003 | Spanyer | A47L 15/50 134/135 |
| 6,848,585 | B2 | 2/2005 | Vanlandingham | |
| 7,231,929 | B2 | 6/2007 | Landsiedel et al. | |
| 7,445,128 | B2 | 11/2008 | Kaczmarek | |
| 7,854,806 | B2 | 12/2010 | Cho et al. | |
| 7,886,917 | B1 | 2/2011 | Berger | |
| 8,104,628 | B2 | 1/2012 | Kim | |
| 8,196,593 | B2 | 6/2012 | Schessl et al. | |
| 2006/0254992 | A1 | 11/2006 | Lim | |
| 2007/0272272 | A1 | 11/2007 | Choi | |
| 2010/0155280 | A1 | 6/2010 | Graute et al. | |
| 2010/0212700 | A1 | 8/2010 | Wattley et al. | |
| 2011/0247990 | A1 | 10/2011 | Chai | |
| 2011/0248609 | A1 * | 10/2011 | Hopfl | A47L 15/006 312/228 |
| 2012/0031432 | A1 | 2/2012 | Beaudet et al. | |
| 2012/0090643 | A1 | 4/2012 | Bertsch et al. | |
| 2012/0138092 | A1 | 6/2012 | Ashrafzadeh et al. | |
| 2012/0279978 | A1 | 11/2012 | Da Pont et al. | |
| 2012/0292270 | A1 | 11/2012 | Klump et al. | |
| 2012/0298155 | A1 | 11/2012 | Blanchard et al. | |
| 2013/0069506 | A1 | 3/2013 | Bennett et al. | |
| 2013/0104944 | A1 | 5/2013 | Motabar et al. | |
| 2014/0190528 | A1 | 7/2014 | Wegener | |
| 2015/0053238 | A1 | 2/2015 | Lee et al. | |
| 2015/0245761 | A1 | 9/2015 | Zhou | |

FOREIGN PATENT DOCUMENTS

| | | | | |
|---|---|---|---|---|
| EP | 0717953 | A1 | 6/1996 | |
| EP | 0962183 | A1 | 12/1999 | |
| EP | 1192893 | A2 | 4/2002 | |
| EP | 1530942 | A1 | 5/2005 | |
| EP | 2030556 | A1 | 3/2009 | |
| EP | 2554097 | A2 * | 2/2013 | A47L 15/502 |
| WO | 2009083576 | A1 | 7/2009 | |

OTHER PUBLICATIONS

U.S. Non-Final Office Action for U.S. Appl. No. 14/458,564 dated May 31, 2016.
U.S. Notice of Allowance for U.S. Appl. No. 14/458,564 dated Sep. 9, 2016.
Morris, C., "Dishwasher Cutlery Racks & Baskets: Which is Best?", Aug. 11, 2011, pp. 1-4, Apartment Therapy, United States [downloaded from http://www.apartmenttherapy.com/dishwasher-cutl-153348 on Sep. 19, 2013].
Extended European Search Report dated Aug. 18, 2015 for European Application No. 15150695.3 from European Patent Office, pp. 1-7, Munich, Germany.
U.S. Non-Final Office Action for U.S. Appl. No. 14/458,564 dated Aug. 5, 2015.
U.S. Final Office Action for U.S. Appl. No. 14/458,564 dated Feb. 10, 2016.
U.S. Advisory Action for U.S. Appl. No. 14/458,564 dated Apr. 29, 2016.
Chinese Office Action dated Jun. 28, 2017 for Chinese Patent Application No. 201510012615.0 from Chinese Patent Office, pp. 1-19, Beijing, China (English-language translation included pp. 1-16).

* cited by examiner

700

| Sensor Information | | | | Load Configuration | | | | | |
|---|---|---|---|---|---|---|---|---|---|
| First Tine Set | Second Tine Set | Third Tine Set | Fourth Tine Set | Column 1 | Column 2 | Column 3 | Column 4 | Column 5 | Column 6 |
| Raised | Raised | Raised | Raised | Dishes & Bowls | Dishes & Bowls | Dishes & Bowls | Dishes & Bowls | Dishes & Bowls | Dishes & Bowls |
| Raised | Raised | Raised | Lowered | Dishes & Bowls | Dishes & Bowls | Dishes & Bowls | Dishes & Bowls | Dishes & Bowls | Cups |
| Raised | Raised | Lowered | Raised | Dishes & Bowls | Dishes & Bowls | Dishes & Bowls | Dishes & Bowls | Cups | Cups |
| Raised | Raised | Lowered | Lowered | Dishes & Bowls | Dishes & Bowls | Dishes & Bowls | Dishes & Bowls | Cups | Cups |
| Raised | Lowered | Raised | Raised | Cups | Cups | Dishes & Bowls | Dishes & Bowls | Dishes & Bowls | Dishes & Bowls |
| Raised | Lowered | Raised | Lowered | Dishes & Bowls | Dishes & Bowls | Dishes & Bowls | Dishes & Bowls | Dishes & Bowls | Cups |
| Raised | Lowered | Lowered | Raised | Dishes & Bowls | Dishes & Bowls | Cups | Cups | Dishes & Bowls | Dishes & Bowls |
| Raised | Lowered | Lowered | Lowered | Dishes & Bowls | Dishes & Bowls | Cups | Cups | Cups | Cups |
| Lowered | Raised | Raised | Raised | Cups | Dishes & Bowls | Dishes & Bowls | Dishes & Bowls | Dishes & Bowls | Dishes & Bowls |
| Lowered | Raised | Raised | Lowered | Cups | Dishes & Bowls | Dishes & Bowls | Dishes & Bowls | Dishes & Bowls | Cups |
| Lowered | Raised | Lowered | Raised | Cups | Dishes & Bowls | Dishes & Bowls | Dishes & Bowls | Dishes & Bowls | Dishes & Bowls |
| Lowered | Raised | Lowered | Lowered | Cups | Dishes & Bowls | Dishes & Bowls | Dishes & Bowls | Dishes & Bowls | Cups |
| Lowered | Lowered | Raised | Raised | Cups | Cups | Dishes & Bowls | Dishes & Bowls | Dishes & Bowls | Dishes & Bowls |
| Lowered | Lowered | Raised | Lowered | Cups | Cups | Dishes & Bowls | Dishes & Bowls | Dishes & Bowls | Cups |
| Lowered | Lowered | Lowered | Raised | Cups | Cups | Cups | Cups | Bowls | Bowls |
| Lowered | Lowered | Lowered | Lowered | Cups | Cups | Cups | Cups | Cups | Cups |

FIG. 22

900

| Sensor Information | | | Load Configuration | | | | | |
|---|---|---|---|---|---|---|---|---|
| Utensil Basket Detected | First and Second Adjustable Tine Set | Third and Fourth Adjustable Tine Set | Column 1 | Column 2 | Column 3 | Column 4 | Column 5 | Column 6 |
| Yes | Raised | Raised | Dishes | Dishes | Dishes | Dishes | Dishes | Utensil Basket |
| Yes | Raised | Lowered | Dishes | Dishes | Pots & Pans | Pots & Pans | Pots & Pans | Utensil Basket |
| Yes | Lowered | Raised | Pots & Pans | Pots & Pans | Pots & Pans | Dishes | Dishes | Utensil Basket |
| Yes | Lowered | Lowered | Pots & Pans | Pots & Pans | Pots & Pans | Pots & Pans | Pots & Pans | Utensil Basket |
| No | Raised | Raised | Dishes | Dishes | Dishes | Dishes | Dishes | Dishes |
| No | Raised | Lowered | Dishes | Dishes | Pots & Pans | Pots & Pans | Pots & Pans | Dishes |
| No | Lowered | Raised | Pots & Pans | Pots & Pans | Pots & Pans | Dishes | Dishes | Dishes |
| No | Lowered | Lowered | Pots & Pans | Pots & Pans | Pots & Pans | Pots & Pans | Pots & Pans | Pots & Pans |

FIG. 24

TINE ADJUSTMENT AND ADAPTABLE WASH CYCLE CONTROL

CROSS-REFERENCE TO RELATED APPLICATIONS

This application claims priority to United States (U.S.) Provisional Patent Application Ser. No. 61/870,154, filed on Aug. 26, 2013, and U.S. Provisional Patent Application Ser. No. 61/878,279, filed on Sep. 16, 2013, both incorporated herein by reference.

TECHNICAL FIELD

One or more embodiments relate generally to dishwashing technology, and in particular, a dishwashing machine with an adaptable wash cycle system.

BACKGROUND

In a conventional dishwashing machine, different wash cycles are available for user selection. A user selected wash cycle, however, may not adequately conform to the contents (e.g., plates, cups, etc.) loaded onto one or more dish racks of the dishwashing machine for washing.

SUMMARY

One embodiment provides a method for customizing a wash cycle of a dishwashing machine. The method comprises gathering sensor information from one or more sensors of the dishwashing machine. The sensor information gathered includes data identifying one or more adjustments to a rack layout of a dish rack of the dishwashing machine. The method further comprises determining a load configuration for the dish rack based on the sensor information gathered. The load configuration determined identifies one or more types of content loaded onto the dish rack. A wash cycle for washing the content loaded onto the dish rack is adapted based on the load configuration determined.

These and other aspects and advantages of one or more embodiments will become apparent from the following detailed description, which, when taken in conjunction with the drawings, illustrate by way of example the principles of one or more embodiments.

BRIEF DESCRIPTION OF THE DRAWINGS

For a fuller understanding of the nature and advantages of one or more embodiments, as well as a preferred mode of use, reference should be made to the following detailed description read in conjunction with the accompanying drawings, in which:

FIG. 22 illustrates a table providing example load configurations for the upper dish rack based on the position of each adjustable tine set, in accordance with an embodiment of the invention.

FIG. 24 illustrates a table providing example load configurations for the lower dish rack based on the position of each adjustable tine set and the presence of a utensil basket, in accordance with an embodiment of the invention.

DETAILED DESCRIPTION

The following description is made for the purpose of illustrating the general principles of one or more embodiments and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

Figure 1:
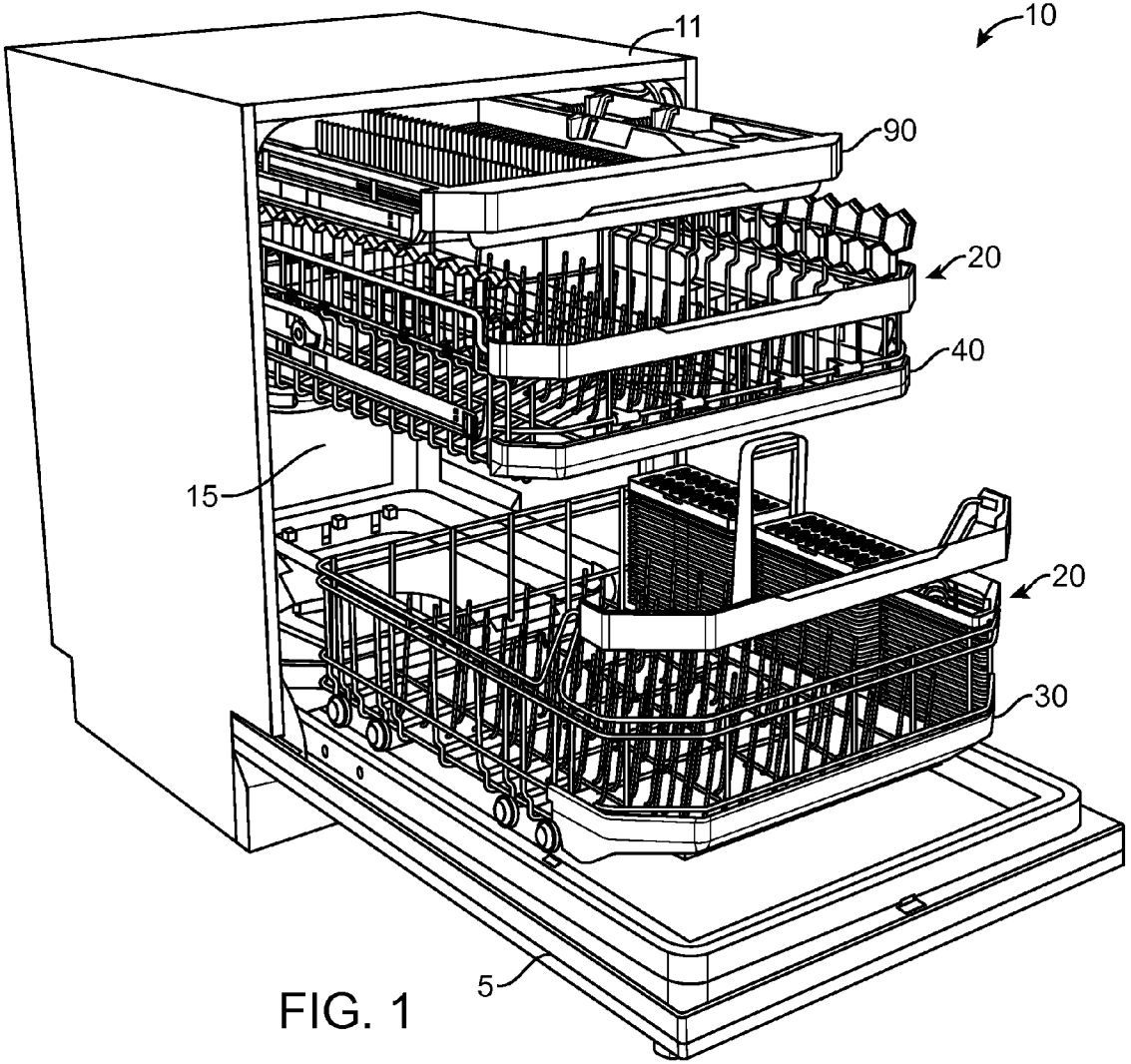
FIG. 1 illustrates a front perspective view of an example dishwashing apparatus, in accordance with an embodiment of the invention.

FIG. 1 illustrates a front perspective view of an example dishwashing apparatus 10, in accordance with an embodiment of the invention. The apparatus 10 comprises a housing 11 with an interior cavity 15 for maintaining at least one dish rack 20. The apparatus 10 further comprises a dishwasher door 5 pivotally coupled to the housing 11.

In one embodiment, the apparatus 10 includes a first dish rack 30 and a second dish rack 40. Within the interior cavity 15, the second dish rack 40 is positioned above, and substantially horizontal to, the first dish rack 30. Therefore, relative to a surface (e.g., ground) that the apparatus 10 is supported upon, the second dish rack 40 is the upper dish rack 40 and the first dish rack 30 is the lower dish rack 30.

Each dish rack 20 has a rack layout that may be customized to receive and maintain content of various shapes and sizes, such as plates, cups, bowls, pots, pans, etc. As described in detail later herein, each dish rack 20 includes at least one rack layout adjustment assembly/device that facilitates manual adjustments to the rack layout of the dish rack 20 to accommodate content of different shapes and sizes.

In one embodiment, the apparatus 10 may further comprise at least one utensil rack 90 shaped to receive and maintain smaller sized content, such as utensils, etc.

When the door 5 is open, each rack 20, 90 is horizontally slidable into and out of the interior cavity 15. For example, as shown in FIG. 1, the racks 20 and 90 are slid out of the interior cavity 15, permitting easy access the racks 20 and 90 for loading content onto, or unloading content from, the racks 20 and 90.

The racks 20 and 90 may be slid into the interior cavity 15 after a user has completed loading content onto, or unloading content from, the racks 20 and 90. If the content loaded onto the racks 20 and 90 are unwashed, a wash cycle for washing the content may be initiated when the user closes the door 5.

Figure 2:
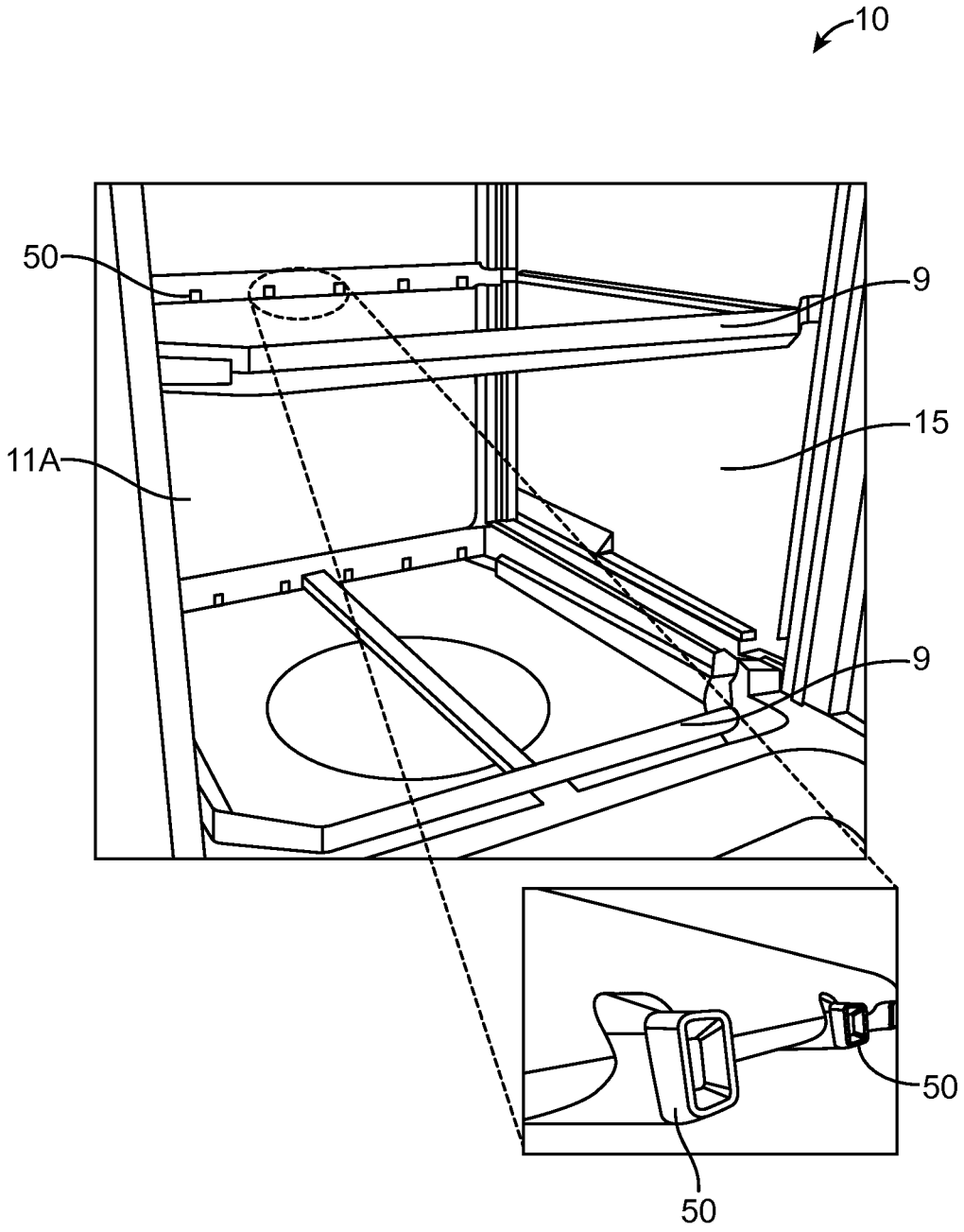
FIG. 2 illustrates the interior cavity of the dishwashing apparatus with the racks and removed for ease of illustration, in accordance with an embodiment of the invention.

FIG. 2 illustrates the interior cavity 50 of the dishwashing apparatus 10 with the racks 20 and 90 removed for ease of illustration, in accordance with an embodiment of the invention. The apparatus 10 further comprises multiple water nozzles 50 positioned along one or more interior sidewalls 11A of the housing 11. The nozzles 50 deliver pressurized water stream during a wash cycle to the content loaded onto the racks 20 and 90. In one embodiment, the nozzles 50 provide a continuous pressurized water stream to a deflector blade 9 positioned within the interior cavity 15. The deflector blade 9 redirects the water stream upwards, and slides towards and away from the nozzles 50 to cover an entire cross-sectional area of the interior cavity 15.

The positions of the nozzles 50 may vary. In one embodiment, a first set of nozzles 50 are positioned below the upper dish rack 40, and a second set of nozzles 50 are positioned below the lower dish rack 30. A first deflector blade 9 positioned below the upper dish rack 40 redirects water stream from the first set of nozzles 50 upwards, and slides towards and away from the first set of nozzles 50. A second deflector blade 9 positioned below the lower dish rack 30 redirects water stream from the second set of nozzles 50 upwards, and slides towards and away from the second set of nozzles 50.

In another embodiment, all nozzles 50 are positioned below the lower dish rack 30. In yet another embodiment, all nozzles 50 are positioned in between the upper dish rack 40 and above the lower dish rack 30.

Figure 3:
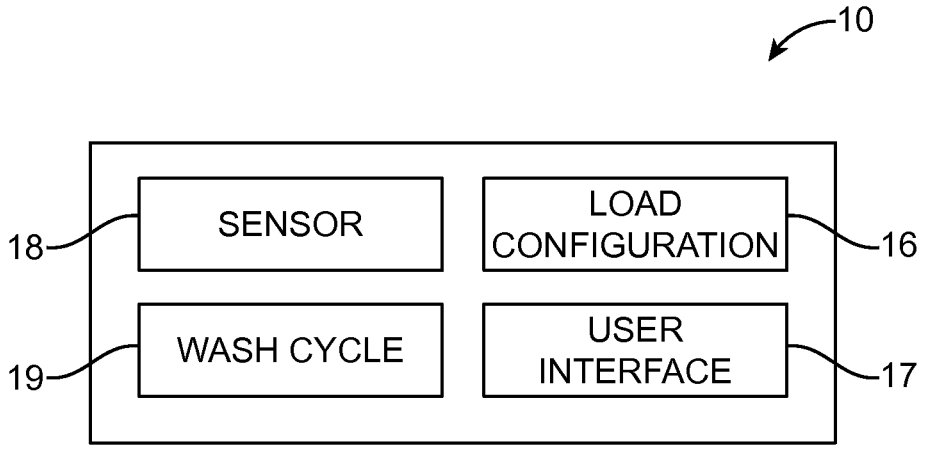
FIG. 3 illustrates a block diagram of the dishwashing apparatus, in accordance with an embodiment of the invention.

FIG. 3 illustrates a block diagram of the dishwashing apparatus 10, in accordance with an embodiment of the invention. The apparatus 10 further comprises a load configuration unit 16, a user interface unit 17, a sensor unit 18, and a wash cycle unit 19.

The sensor unit 18 is configured to gather sensor data indicating one or more manual adjustments to each rack layout of each dish rack 20. Based on the sensor data gathered, the load configuration unit 18 determines load configuration information for each dish rack 20. Load configuration information for each dish rack 20 may include information identifying one or more types of content loaded onto the dish rack 20, and information identifying which portion of the dish rack 20 that each type of content is loaded onto.

The user interface unit 17 is disposed along an exterior of the dishwashing apparatus 10. For example, the user interface unit 17 may be disposed along a top exterior sidewall of the housing 11. In another embodiment, the user interface unit 17 may be disposed along an exterior surface of the dishwasher door 5. The user interface unit 17 displays the load configuration to a user for user input. The user input may include either user approval of the load configuration or one or more user provided adjustments to the load configuration. In one embodiment, the user interface unit 17 comprises one or more of the following: a display screen, a keypad, a touch interface, one or more dials, one or more knobs, one or more switches, one or more selector buttons, one or more capacitive buttons and/or interfaces, etc.

Based on the user input and the load configuration of each dish rack 20, the wash cycle unit 19 adapts a wash cycle for washing content loaded onto each rack 20. Specifically, the wash cycle unit 19 customizes the wash cycle by adjusting one or more wash cycle parameters, such as the amount of water pressure of water stream delivered by each nozzle 50, the range of motion of the deflector blade, the speed of the deflector blade, the duration of time the deflector blade is in motion, and the position of the deflector blade.

Figure 4:
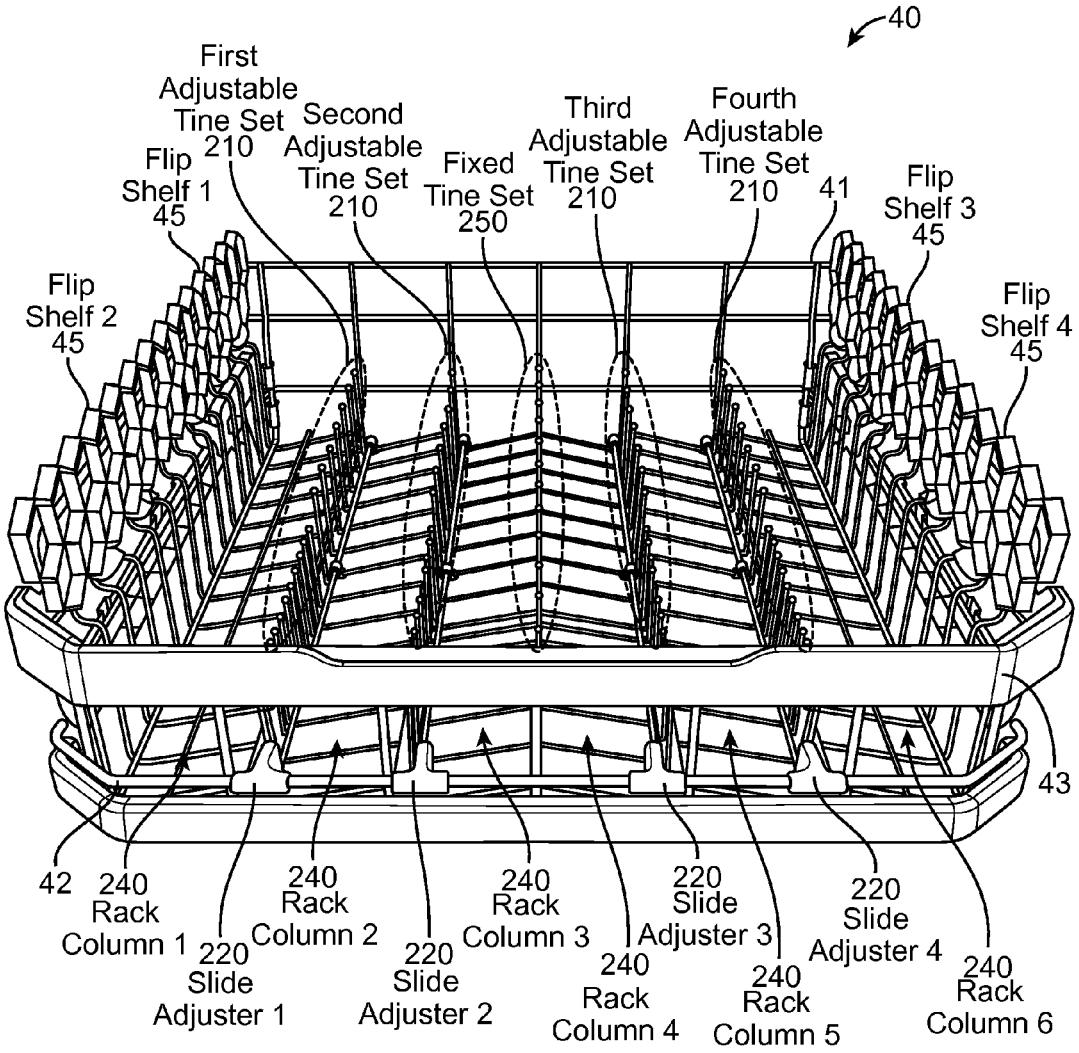
FIG. 4 illustrates a front perspective view of the upper dish rack, in accordance with an embodiment of the invention.
Figure 5:
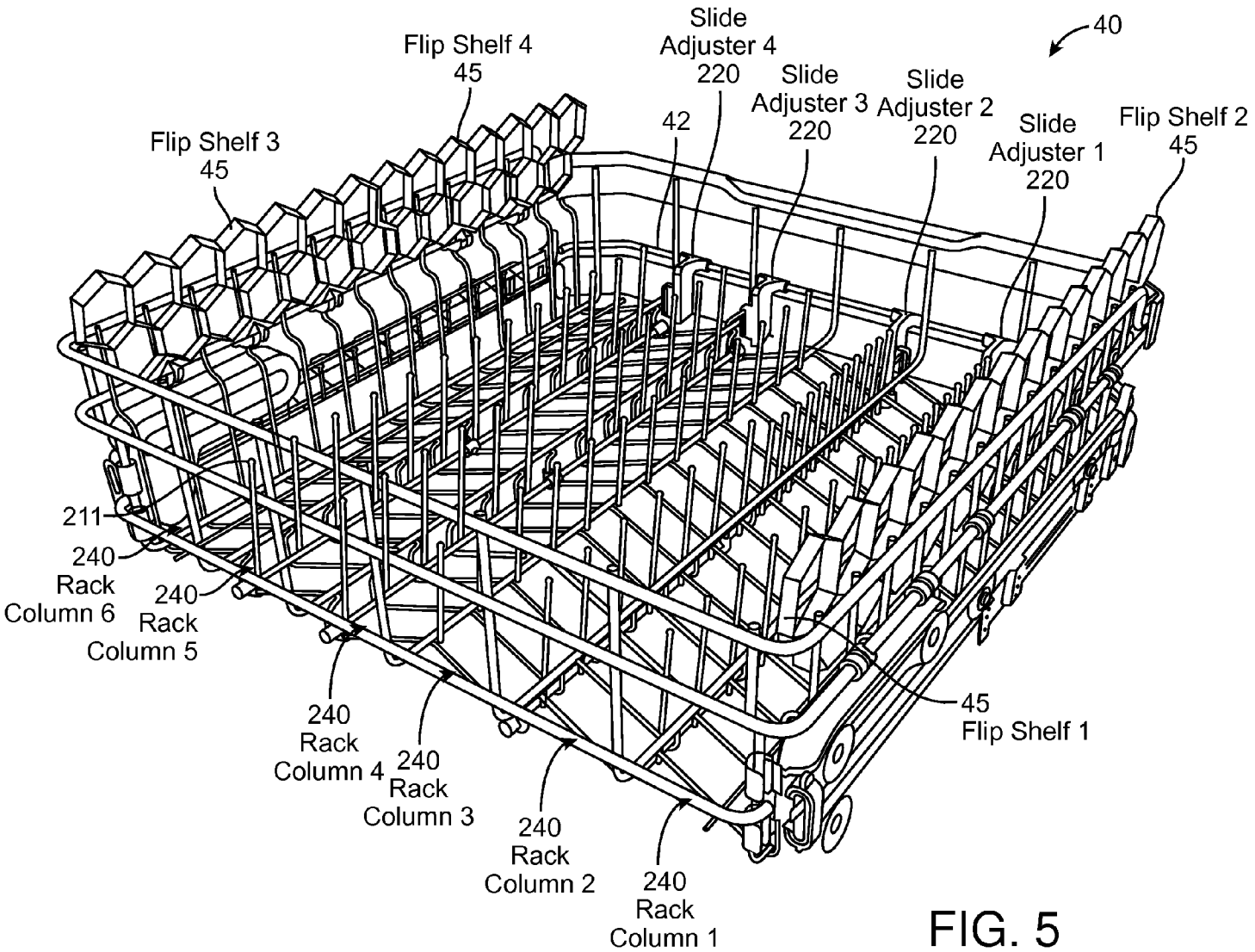
FIG. 5 illustrates a rear perspective view of the upper dish rack in FIG. 4, in accordance with an embodiment of the invention.

FIG. 4 illustrates a front perspective view of the upper dish rack 40, in accordance with an embodiment of the invention. FIG. 5 illustrates a rear perspective view of the upper dish rack 40 in FIG. 4, in accordance with an embodiment of the invention. The upper dish rack 40 includes a rack frame 41 with multiple sides. The rack frame 41 includes a first pair of opposing sides 41A (FIG. 6) and 41B (FIG. 6), a second pair of opposing sides 41D (FIG. 8) and 41E (FIG. 9), and a bottom side 41C (FIG. 6) extending between the sides 41A, 41B, 41D and 41E. The second pair of opposing sides 41D and 41E represent the front side and the rear side of the rack frame 41, respectively.

The upper dish rack 40 further includes a handle bar 43 coupled to the rack frame 41. When the door 5 is open, a user may utilize the handle bar 43 to horizontally slide the upper dish rack 40 into, or out of, the interior cavity 15.

The upper dish rack 40 further comprises multiple tine sets, wherein each tine set includes a plurality of tines 211 (FIG. 5). Specifically, a fixed tine set 250 is fixedly coupled to the bottom side 41C of the rack frame 41. The tines 211 of the fixed tine set 250 are positioned vertically and may not be adjusted.

Additionally, one or more adjustable tine sets 210 are pivotally coupled to the bottom side 41C of the rack frame 41. In one embodiment, for each adjustable tine set 210, each tine 211 of the adjustable tine set 210 is fixedly coupled to a corresponding rotatable member 212 extending along the bottom side 41C of the rack frame 41. Unlike the fixed tine set 250, each adjustable tine set 210 may be individually rotated to adjust a rack layout of the upper dish rack 40 to accommodate content of various shapes and sizes.

Figure 6:
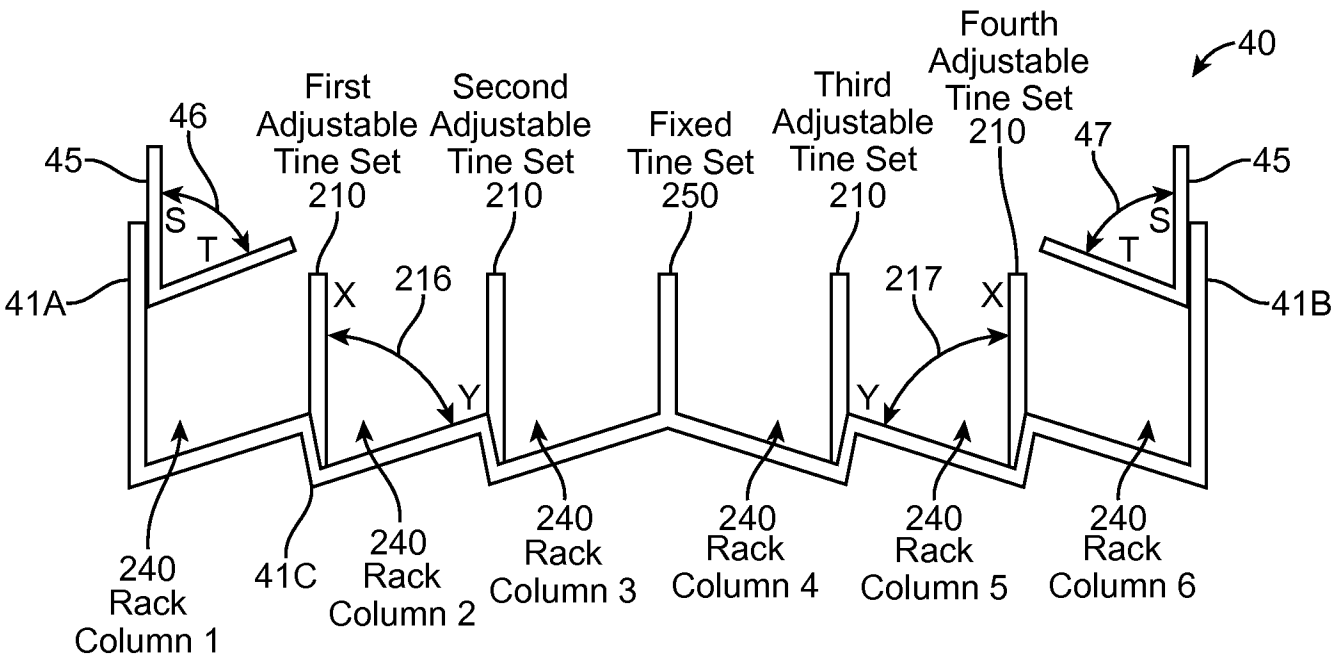
FIG. 6 illustrates a cross-section of the upper dish rack and example rotation ranges for the adjustable tine sets, in accordance with an embodiment of the invention.

For example, as shown in FIGS. 4-5, the upper dish rack 40 includes at least a first adjustable tine set 210, a second adjustable tine set 210, a third adjustable tine set 210 and a fourth adjustable tine set 210. The tines 211 of each adjustable tine set 210 may be rotated between different positions. In one embodiment, the tines 211 of each adjustable tine set 210 may be raised to a substantially vertical position X (FIG. 6), or lowered to a substantially horizontal position Y (FIG. 6). For example, in FIG. 4, the tines 211 of each adjustable tine set 210 are raised to the substantially vertical position X. By comparison, in FIG. 8, the tines 211 of each adjustable tine set 210 are lowered to the substantially horizontal position Y. The tines 211 of each adjustable tine set 210 lie flush against the bottom side 41C of the rack frame 41 when positioned in the substantially horizontal position Y.

In one embodiment, the tines 211 of each adjustable tine set 210 may also be positioned in one or more intermediate positions between the substantially vertical position X and the substantially horizontal position Y.

Each adjustable tine set 210 is interconnected to a corresponding slide adjuster 220 for rotating the tines 211 of the adjustable tine set 210. Each slide adjuster 220 is slidably coupled to a guide track 42 of a side of the rack frame 41, for example the front side 41D.

For example, as shown in FIGS. 4-5, the upper dish rack 40 further comprises a first slide adjuster 220 (Slide Adjuster 1), a second slide adjuster 220 (Slide Adjuster 2), a third slide adjuster 220 (Slide Adjuster 3) and a fourth slide adjuster 220 (Slide Adjuster 4) corresponding to the first adjustable tine set 210, the second adjustable tine set 210, the third adjustable tine set 210 and the fourth adjustable tine set 210, respectively.

An adjustable tine set 210 and a corresponding slide adjuster 220 together represent an example configuration of a rack layout adjustment device. As described in detail later herein, each slide adjuster 220 is manually slidable back and forth along a portion of the guide track 42 to rotate the tines 211 of a corresponding tine set 210 to adjust the rack layout of the upper dish rack 40.

The tine sets 210 and 250 are spaced apart between the opposing sides 41A and 41B of the rack frame 41, resulting in multiple rack columns 240. For example, as shown in FIGS. 4-5, the upper dish rack 40 includes at least a first rack column 240 (Rack Column 1) positioned between the side 41A of the rack frame 41 and the first adjustable tine set 210, a second rack column 240 (Rack Column 2) positioned between the first adjustable tine set 210 and the second adjustable tine set 210, a third rack column 240 (Rack Column 3) positioned between the second adjustable tine set 210 and the fixed tine set 250, a fourth rack column 240 (Rack Column 4) positioned between the fixed tine set 250 and the third adjustable tine set 210, a fifth rack column 240 (Rack Column 5) positioned between the third adjustable tine set 210 and the fourth adjustable tine set 210, and a sixth rack column 240 (Rack Column 6) positioned between the fourth adjustable tine set 210 and the side 41B of the rack frame 41.

The upper dish rack 40 further comprises one or more rotatable flip shelves 45. For example, as shown in FIGS. 4-5, the upper dish rack 40 may include a first flip shelf 45 (Flip Shelf 1) and a second flip shelf 45 (Flip Shelf 2) pivotally coupled to the side 41A of the rack frame 41, and a third flip shelf 45 (Flip Shelf 3) and a fourth flip shelf 45 (Flip Shelf 4) pivotally coupled to the side 41B of the rack frame 41.

Each flip shelf 45 may be rotated between different positions. In one embodiment, each flip shelf 45 may be raised to a substantially vertical position S (FIG. 6), or lowered to a tilt position T (FIG. 6). For example, in FIG. 4, each flip shelf 45 is raised to the substantially vertical position S. By comparison, in FIG. 8, each flip shelf 45 is lowered to the tilt position T.

The first and second flip shelves 45 may be raised to the substantially vertical position S to allow for large and/or tall content (e.g., long-stemmed wine glasses or tall glasses) to be loaded onto and maintained within the first rack column 240. The third and fourth flip shelves 45 may be raised to the substantially vertical position S to allow for large and/or tall content (e.g., long-stemmed wine glasses or tall glasses) to be loaded onto and maintained within the sixth rack column 240.

The first and second flip shelves 45 may be lowered to the substantially tilt position T to maintain small and/or short content (e.g., espresso cups, mugs) loaded onto the first rack column 240. The third and fourth flip shelves 45 may be lowered to the substantially tilt position T to maintain small and/or short content (e.g., espresso cups, mugs) loaded onto the sixth rack column 240.

FIG. 6 illustrates a cross-section of the upper dish rack 40 and example rotation ranges for the adjustable tine sets 210, in accordance with an embodiment of the invention. The bottom surface 41C of the rack frame 41 may have different configurations. In one embodiment, as shown in FIG. 6, the bottom surface 41C of the rack frame 41 has a substantially sawtooth configuration, such that a bottom of each rack column 240 is substantially angular. In another embodiment, the bottom surface 41C has a substantially flat configuration, such that a bottom of each rack column 240 is substantially flat.

In one embodiment, the first and second adjustable tine sets 210 are rotatable between the substantially vertical position X and the substantially horizontal position Y along a rotation range 216. The third and fourth adjustable tine sets 210 are rotatable between the substantially vertical position X and the substantially horizontal position Y along a rotation range 217.

In one embodiment, the first and second adjustable tine sets 210 may also be positioned at one or more intermediate positions along the rotation range 216 between the substantially vertical position X and the substantially horizontal position Y. The third and fourth adjustable tine sets 210 may also be positioned at one or more intermediate positions along the rotation range 217 between the substantially vertical position X and the substantially horizontal position Y.

In one embodiment, the first and second flip shelves 45 are rotatable between the substantially vertical position S and the tilt position T along a rotation range 46. The third and fourth flip shelves 45 are rotatable between the substantially vertical position S and the tilt position T along a rotation range 47.

Figure 7:
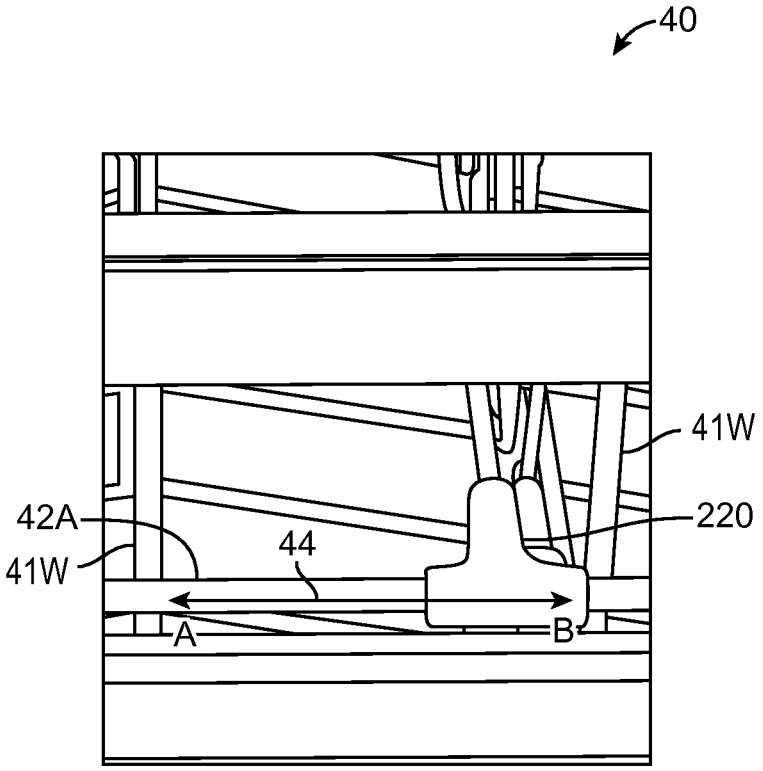
FIG. 7 illustrates an example slide adjuster for a corresponding adjustable tine set, in accordance with an embodiment of the invention.

FIG. 7 illustrates an example slide adjuster 220 for a corresponding adjustable tine set 210, in accordance with an embodiment of the invention. The slide adjuster 220 is manually slidable back and forth in a horizontal direction 44 along a portion 42A of the guide track 42, wherein the portion 42A is disposed between two rack wires 41W of the side 41D.

In one embodiment, manually sliding the slide adjuster 220 to a first point A raises the adjustable tine set 210 to the substantially vertical position X, and manually sliding the slide adjuster 220 to a second point B lowers the adjustable tine set 210 to the substantially horizontal position Y. For example, the first and second slide adjusters 220 operate in this manner.

In another embodiment, manually sliding the slide adjuster 220 to the first point A lowers the adjustable tine set 210 to the substantially horizontal position Y, and manually sliding the slide adjuster 220 to the second point B raises the adjustable tine set 210 to the substantially vertical position X. For example, the third and fourth slide adjusters 220 operate in this manner.

Figure 8:
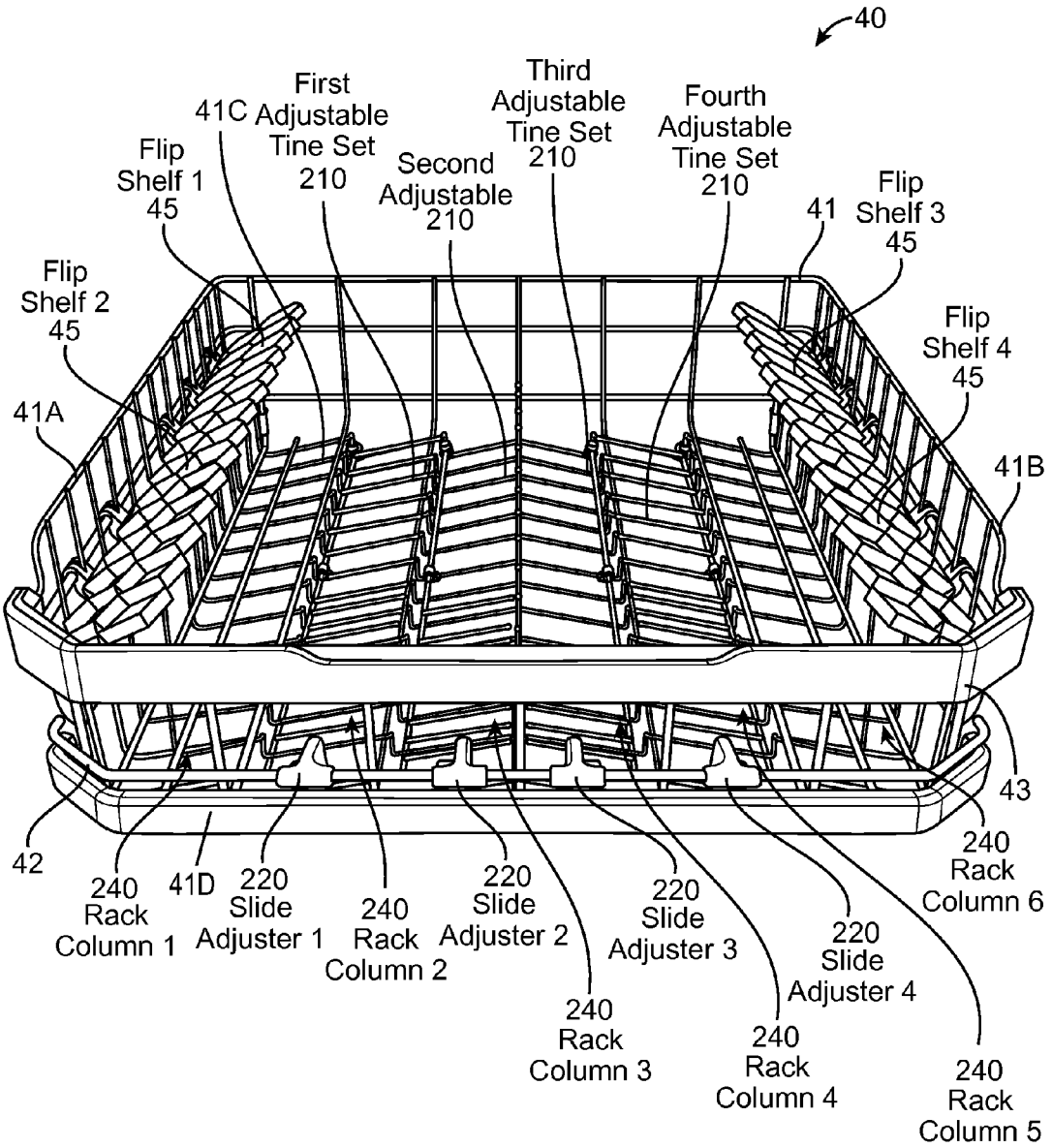
FIG. 8 illustrates a front perspective view of the upper dish rack, wherein the adjustable tine sets are lowered to the substantially horizontal position, in accordance with an embodiment of the invention.

FIG. 8 illustrates a front perspective view of the upper dish rack 40, wherein the adjustable tine sets 210 are lowered to the substantially horizontal position Y, in accordance with an embodiment of the invention. Also shown in FIG. 8, each flip shelf 45 is lowered to the tilt position T.

Figure 9:
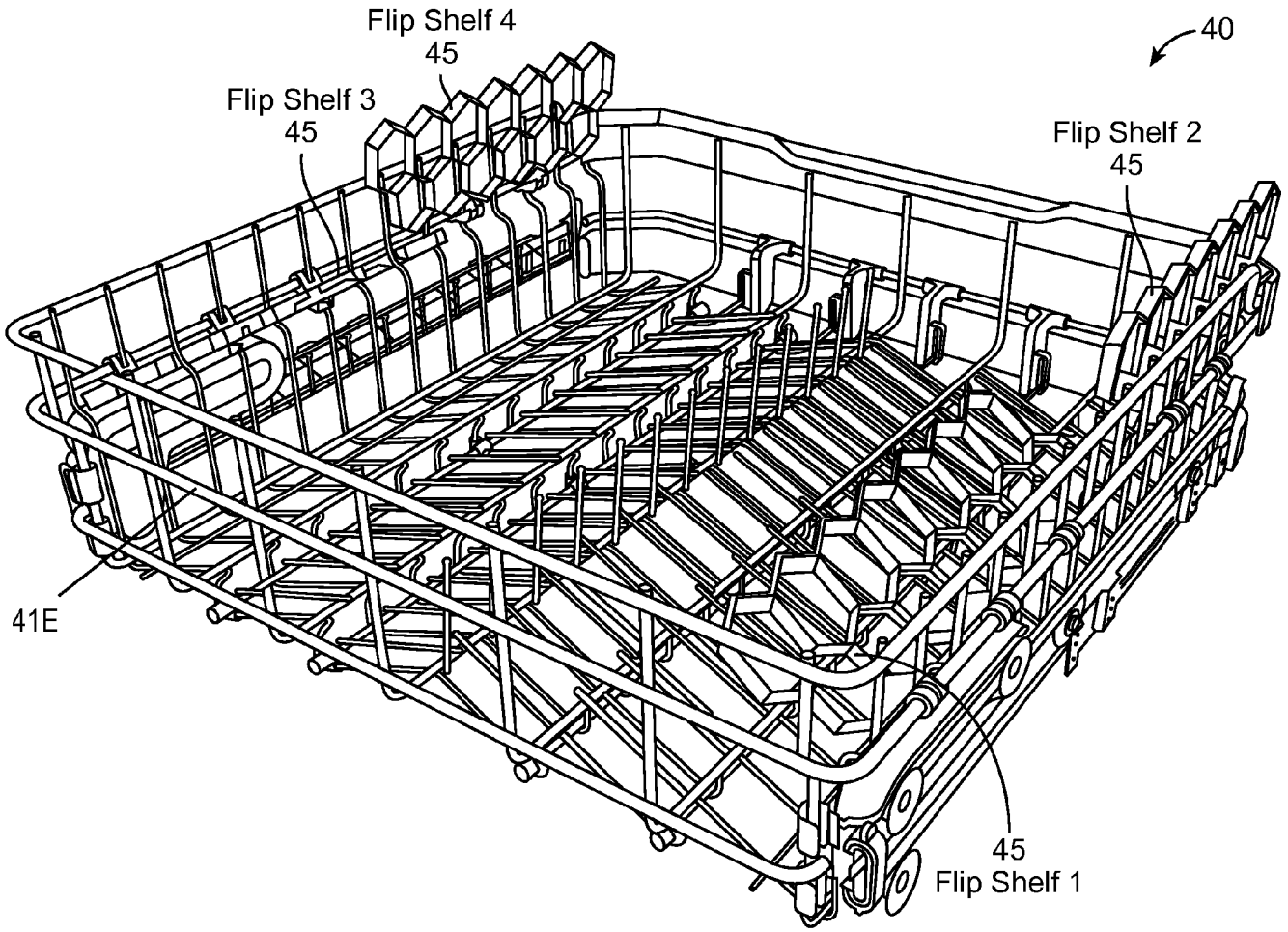
FIG. 9 illustrates a rear perspective view of the upper dish rack, wherein the adjustable tine sets are lowered to the substantially horizontal position, in accordance with an embodiment of the invention.

FIG. 9 illustrates a rear perspective view of the upper dish rack 40, wherein the adjustable tine sets 210 are lowered to the substantially horizontal position Y, in accordance with an embodiment of the invention. Also shown in FIG. 9, the second and fourth flip shelves 45 are raised to the substantially vertical position S, whereas the first and third flip shelves 45 are lowered to the tilt position T.

Figure 10:
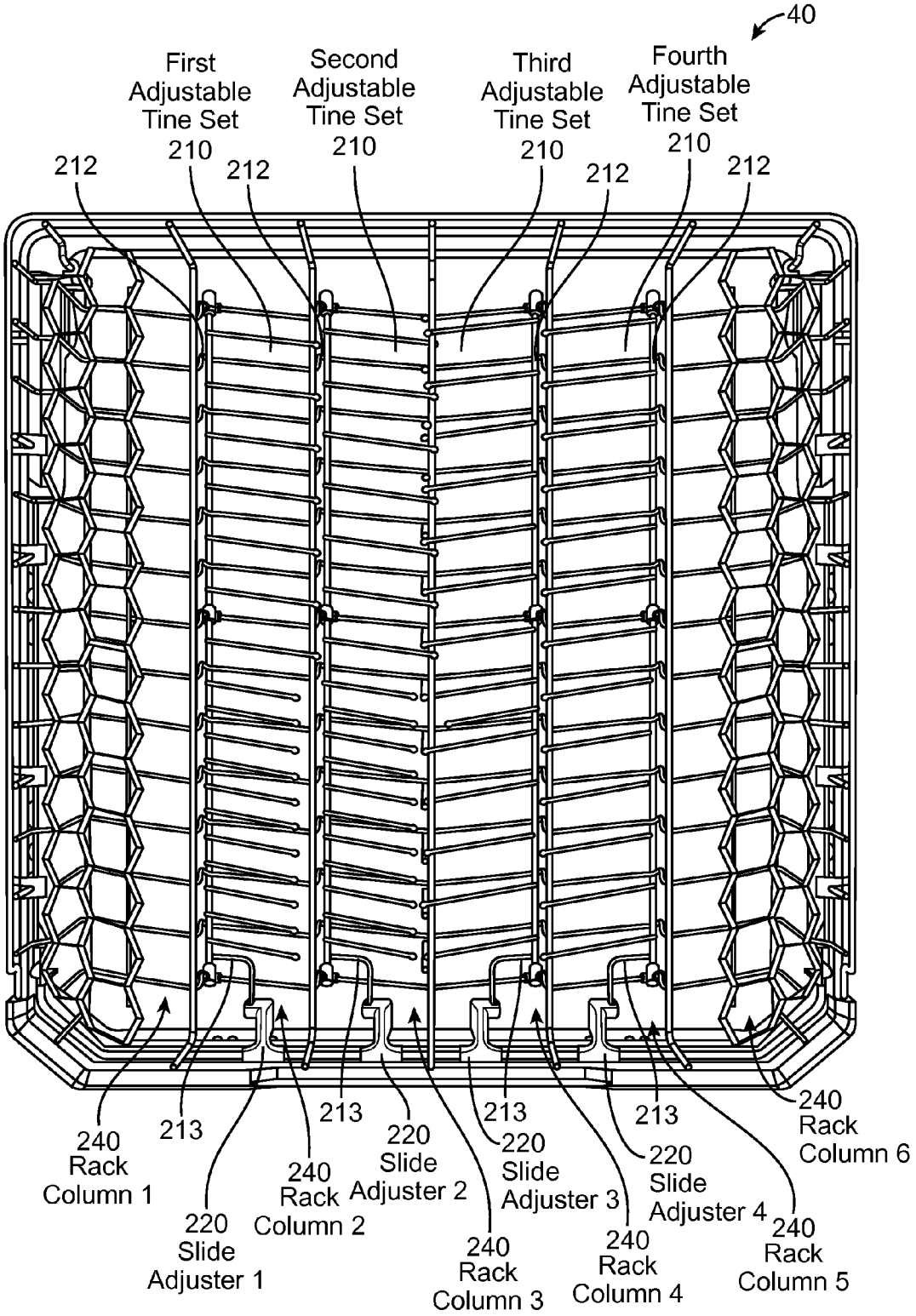
FIG. 10 illustrates a top view of the upper dish rack, in accordance with an embodiment of the invention.

FIG. 10 illustrates a top view of the upper dish rack 40, in accordance with an embodiment of the invention. As stated above, each adjustable tine set 210 may be individually rotated to adjust a rack layout of the upper dish rack 40 to accommodate content of various shapes and sizes. For each adjustable tine set 210, each tine 211 of the adjustable tine set 210 is fixedly coupled to a rotatable member 212 that in turn is coupled to a corresponding slide adjuster 220 via a connection mechanism 213. Manually sliding the slide adjuster 220 along a portion 42A of the guide track 42 causes the member 212 to rotate to either raise or lower the tines 211 of the adjustable tine set 210.

Figure 11:
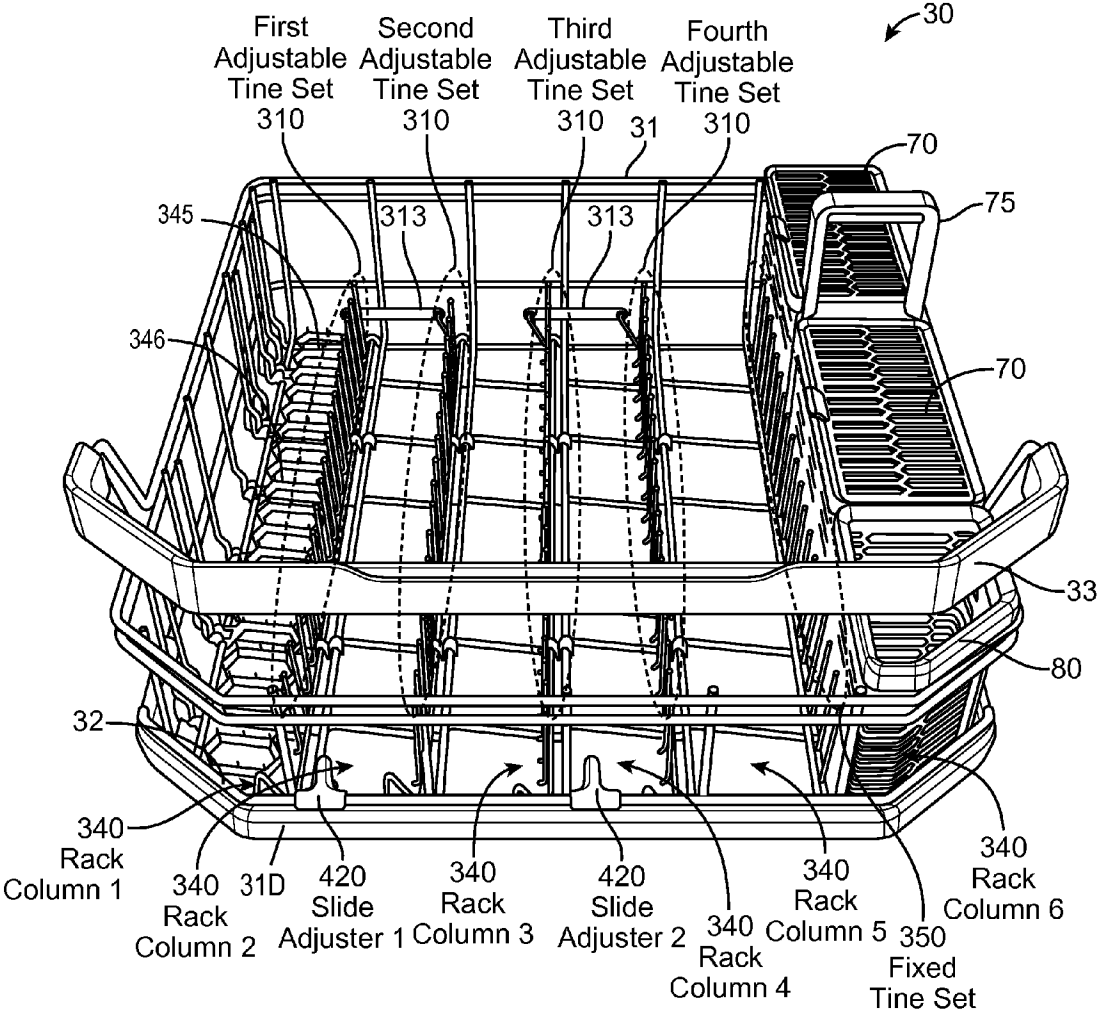
FIG. 11 illustrates a front perspective view of the lower dish rack, in accordance with an embodiment of the invention.
Figure 12:
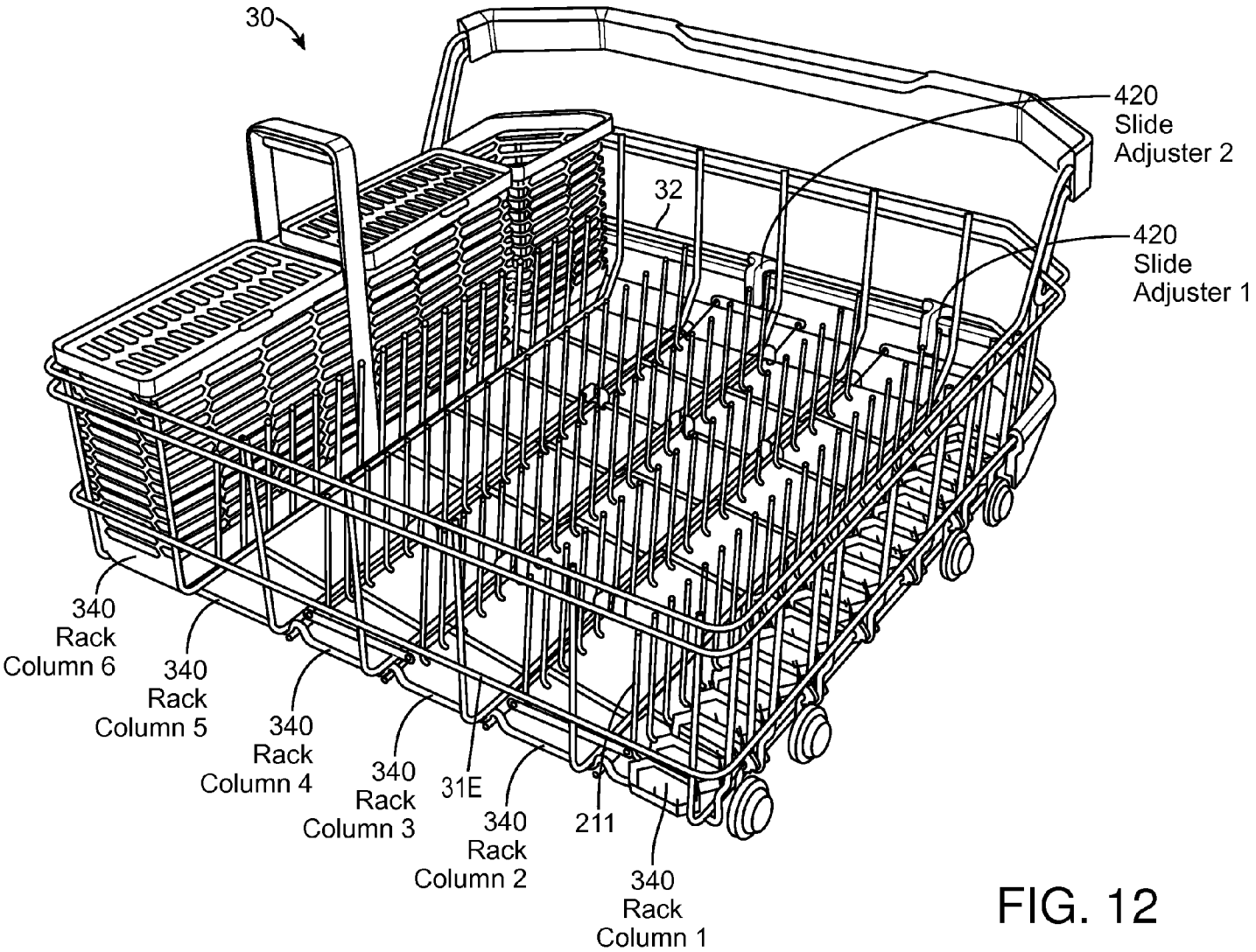
FIG. 12 illustrates a rear perspective view of the lower dish rack in FIG. 11, in accordance with an embodiment of the invention.

FIG. 11 illustrates a front perspective view of the lower dish rack 30, in accordance with an embodiment of the invention. FIG. 12 illustrates a rear perspective view of the lower dish rack 30 in FIG. 11, in accordance with an embodiment of the invention. The lower dish rack 30 includes a rack frame 31 with multiple sides. The rack frame 31 includes a first pair of opposing sides 31A (FIG. 13) and 31B (FIG. 13), a second pair of opposing sides 31D (FIG. 11) and 31E (FIG. 12), and a bottom side 31C (FIG. 13) extending between the sides 31A, 31B, 31D and 31E. The second pair of opposing sides 31D and 31E represent the front side and the rear side of the rack frame 31, respectively.

The lower dish rack 30 further includes a handle bar 33 coupled to the rack frame 31. When the door 5 is open, a user may utilize the handle bar 33 to horizontally slide the lower dish rack 30 into, or out of, the interior cavity 15.

The lower dish rack 30 further comprises multiple tine sets, wherein each tine set includes a plurality of tines 211. Specifically, a fixed tine set 350 is fixedly coupled to the bottom side 31C of the rack frame 31. The tines 211 of the fixed tine set 350 are positioned vertically and may not be adjusted.

Additionally, one or more adjustable tine sets 310 are pivotally coupled to the bottom side 31C of the rack frame 31. In one embodiment, for each adjustable tine set 310, each tine 211 of the adjustable tine set 310 is fixedly coupled to a corresponding rotatable member 312 extending along the bottom side 31C of the rack frame 31. Unlike the fixed tine set 350, the adjustable tine sets 310 are rotatable to adjust a rack layout of the lower dish rack 30 to accommodate content of various shapes and sizes.

Figure 13:
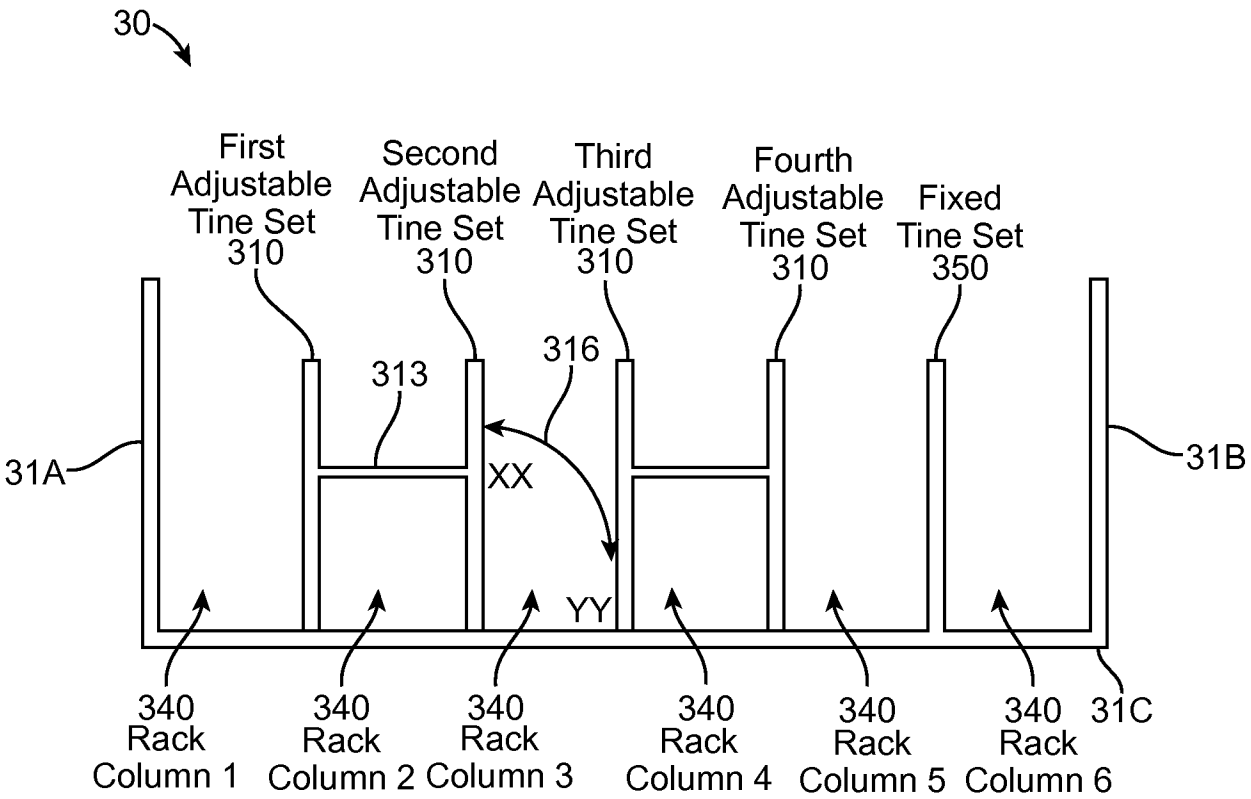
FIG. 13 illustrates a cross-section of the lower dish rack and example rotation ranges for the adjustable tine sets, in accordance with an embodiment of the invention.

For example, as shown in FIGS. 11-12, the lower dish rack 30 includes at least a first adjustable tine set 310, a second adjustable tine set 310, a third adjustable tine set 310 and a fourth adjustable tine set 310. The tines 211 of each adjustable tine set 310 may be rotated between different positions. In one embodiment, the tines 211 of each adjustable tine set 310 may be raised to a substantially vertical position XX (FIG. 13), or lowered to a substantially horizontal position YY (FIG. 13). For example, in FIG. 11, the tines 211 of each adjustable tine set 310 are raised to the substantially vertical position XX. By comparison, in FIG. 15, the tines 211 of each adjustable tine set 310 are lowered to the substantially horizontal position YY. The tines 211 of each adjustable tine set 310 lie flush against the bottom side 31C of the rack frame 31 when positioned in the substantially horizontal position YY.

In one embodiment, the tines 211 of each adjustable tine set 310 may also be positioned in one or more intermediate positions between the substantially vertical position XX and the substantially horizontal position YY.

In one embodiment, the adjustable tine sets 310 are rotatable in pairs. A pair of adjustable tine sets 310 is interconnected to a corresponding slide adjuster 420 for simultaneously rotating the tines 211 of the pair of adjustable tine sets 310. Each slide adjuster 420 is slidably coupled to a guide track 32 of a side of the rack frame 31, for example the front side 31D.

For example, as shown in FIGS. 11-12, the lower dish rack 30 further comprises a first slide adjuster 420 (Slide Adjuster 1) for simultaneously rotating the tines 211 of the first and second adjustable tine sets 310. The lower dish rack 30 further comprises a second slide adjuster 420 (Slide Adjuster 2) for simultaneously rotating the tines 211 of the third and fourth adjustable tine sets 310.

A pair of adjustable tine sets 310 and a corresponding slide adjuster 420 together represent an example configuration of a rack layout adjustment device. As described in detail later herein, each slide adjuster 420 is manually slidable back and forth along a portion of the guide track 32 to simultaneously rotate the tines 211 of a corresponding pair of adjustable tine sets 210 to adjust the rack layout of the lower dish rack 30.

In another embodiment, each adjustable tine set 310 is individually rotatable. Each adjustable tine set 310 is interconnected to a corresponding slide adjuster 420 for simultaneously rotating the tines 211 of the adjustable tine sets 310.

The tine sets 310 and 350 are spaced apart between opposing sides 31A and 31B of the rack frame 31, resulting in multiple rack columns 340. For example, as shown in FIGS. 11-12, the lower dish rack 30 includes at least a first rack column 340 (Column 1) positioned between the side 31A of the rack frame 31 and the first adjustable tine set 310, a second rack column 340 (Column 2) positioned between the first adjustable tine set 310 and the second adjustable tine set 310, a third rack column 340 (Column 3) positioned between the second adjustable tine set 310 and the third adjustable tine set 310, a fourth rack column 340 (Column 4) positioned between the third adjustable tine set 310 and the fourth adjustable tine set 310, a fifth rack column 340 (Column 5) positioned between the fourth adjustable tine set 310 and the fixed tine set 350, and a sixth rack column 340 (Column 6) positioned between the fixed tine set 350 and the side 31B of the rack frame 31.

The lower dish rack 30 further comprises a flip part 345 pivotally coupled to the side 31A of the rack frame 31. The flip part 345 includes multiple stems 346. The flip part 345 may be rotated to lie flush against a bottom side 31C of the rack frame 31, allowing for substantially large and/or substantially narrow items, like cutting boards, to rest atop the stems 346 of the flip part 345. The stems 346 function as stoppers, allowing tight stacking of substantially large and/or substantially narrow items, such as cutting boards, within the rack frame 31.

The lower dish rack 30 further comprises one or more removable utensil baskets. As shown in FIG. 11, the first dish rack 30 may include a pair of utensil baskets 70 that are detachably coupled (e.g., via magnets, clips, etc.) to a center handle 75. The handle 75 allows ease of carrying through alignment between a center of gravity of the utensil baskets 70 and a user's point of contact with the utensil baskets 70. For example, when the door 5 is open and the lower dish rack 30 is slid out of the interior cavity 15, the user may utilize the handle 75 to remove the utensil baskets 70 from, or insert the utensil baskets 70 into, the lower dish rack 30.

In one embodiment, the handle 75 may be extendable (e.g., telescopic) to provide better access for the user when the utensil baskets 70 are full. A mechanism for the extendable handle 75 allows the handle 75 to slide upwards a specific distance. Struts connecting the handle 75 to the utensil baskets 70 may slide upwards a specific distance or the entire handle 75 may be configured to move. Optionally, the struts may be hollow and telescope to extend the handle 75. Telescoping action may be controlled via a button on the handle 75 (e.g., the handle 75 is locked in a raised or lowered position until the button press releases the handle 75 to allow movement).

Each utensil basket 70 has a corresponding lid 71 pivotally coupled (e.g., via hinges) to the utensil basket 70. The lids 71 allowing individual portions of the utensil baskets 70 to be raised to accommodate various contents within the utensil baskets 70.

The first dish rack 30 may further include a utensil basket without a lid, such as a utensil basket 80 shown in FIG. 11.

FIG. 13 illustrates a cross-section of the lower dish rack 30 and example rotation ranges for the adjustable tine sets 310, in accordance with an embodiment of the invention. The first and second adjustable tine sets 310 are simultaneously rotatable between the substantially vertical position XX and the substantially horizontal position YY along rotation range 316. The third and fourth adjustable tine sets 210 are also simultaneously rotatable between the substantially vertical position XX and the substantially horizontal position YY along the rotation range 316.

Figure 14:
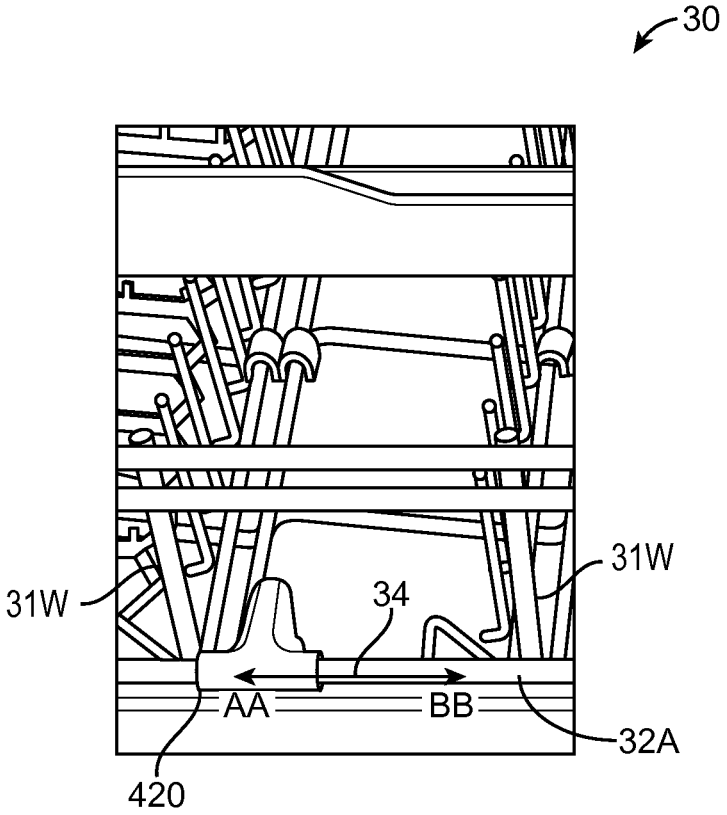
FIG. 14 illustrates an example slide adjuster for a pair of adjustable tine set, in accordance with an embodiment of the invention.

FIG. 14 illustrates an example slide adjuster 420 for a pair of adjustable tine sets 310, in accordance with an embodiment of the invention. The slide adjuster 420 is manually slidable back and forth in a horizontal direction 34 along a portion 32A of the guide track 32, wherein the portion 32A is disposed between two rack wires 31W of the side 31D.

In one embodiment, manually sliding the slide adjuster 420 to a first point A raises the pair of adjustable tine sets 310 to the substantially vertical position XX, and manually sliding the slide adjuster 420 to a second point BB lowers the pair of adjustable tine sets 310 to the substantially horizontal position YY. For example, the first and second slide adjusters 420 operate in this manner.

Figure 15:
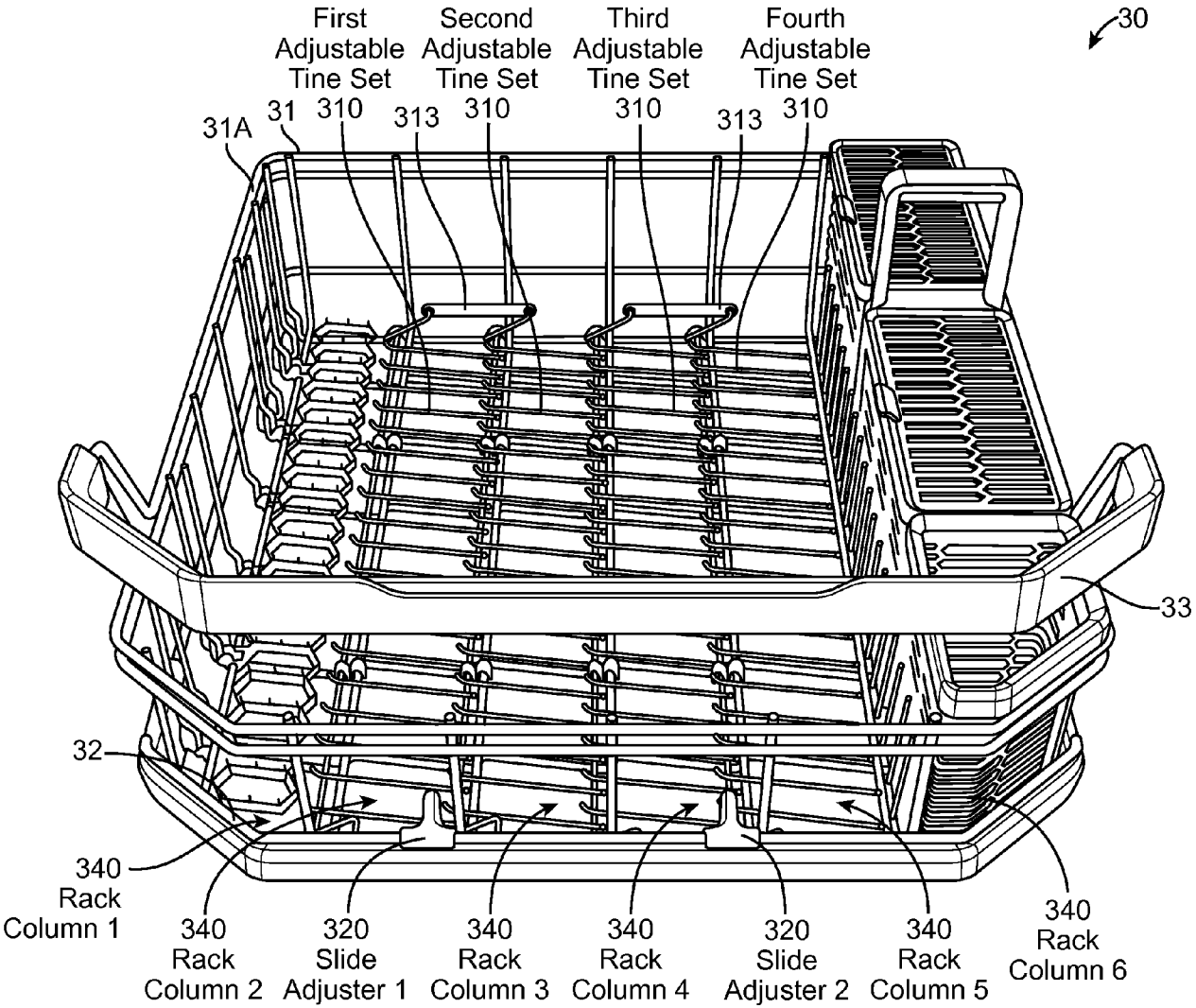
FIG. 15 illustrates a front perspective view of the lower dish rack, wherein the adjustable tine sets are lowered to the substantially horizontal position, in accordance with an embodiment of the invention.
Figure 16:
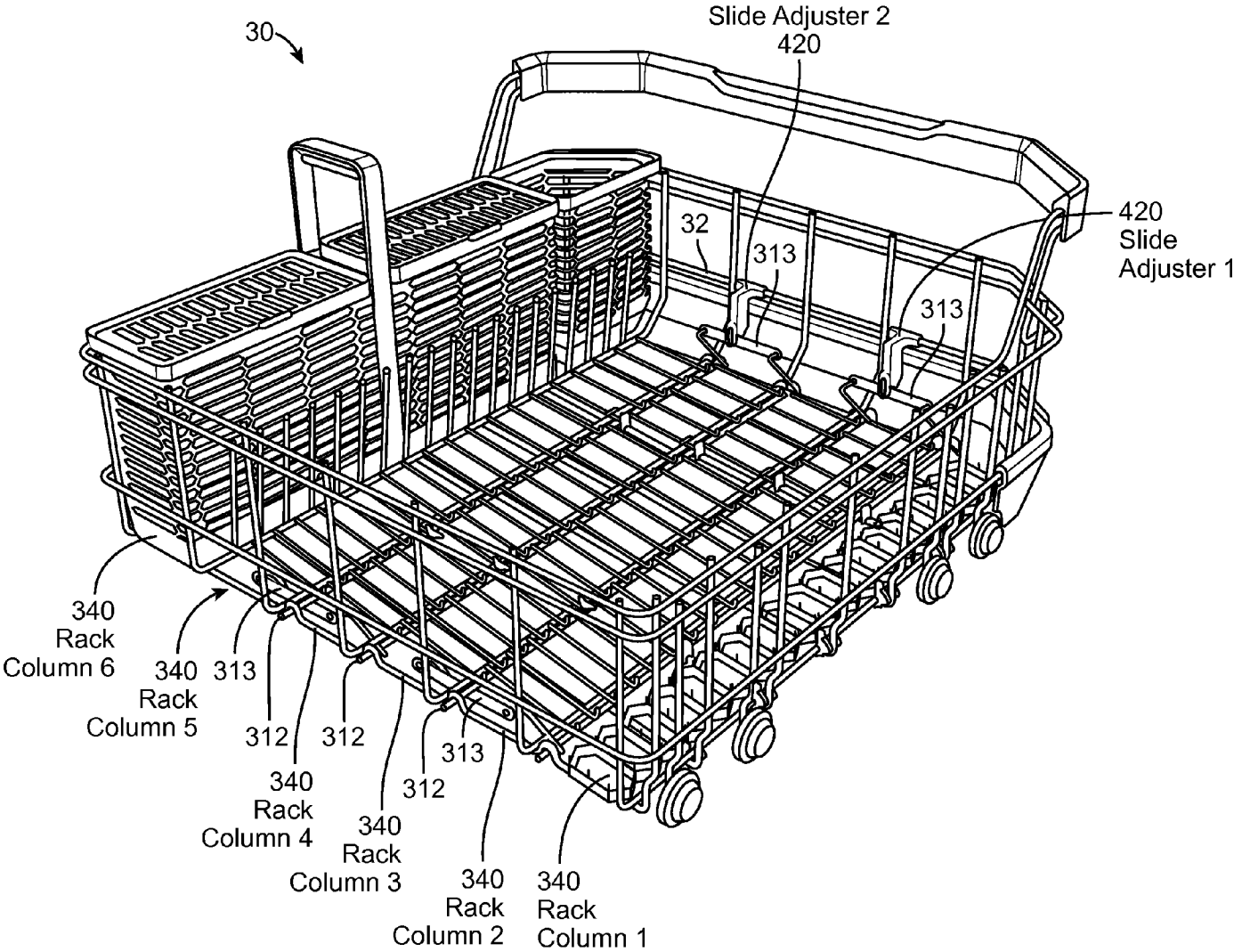
FIG. 16 illustrates a rear perspective view of the lower dish rack in FIG. 15, in accordance with an embodiment of the invention.

FIG. 15 illustrates a front perspective view of the lower dish rack 30, wherein the adjustable tine sets 310 are lowered to the substantially horizontal position YY, in accordance with an embodiment of the invention. FIG. 16 illustrates a rear perspective view of the lower dish rack 30 in FIG. 15, in accordance with an embodiment of the invention. For each adjustable tine set 310 of a pair of adjustable tine sets 310, each tine 211 of the adjustable tine set 310 is fixedly coupled to a rotatable member 312 that in turn is coupled to a corresponding slide adjuster 420 for the pair of adjustable tine sets 310 via a connection mechanism 313. Manually sliding the slide adjuster 420 along a portion 42A of the guide track 42 causes the member 312 to rotate to either raise or lower the tines 211 of the pair of adjustable tine sets 310.

In one embodiment, the slide adjuster 420 is attached to a cam plate that in turn is coupled to the rotatable member 312 via the connection mechanism 313. The cam plate 380 transforms linear motion resulting from manually sliding the slide adjuster 420 to rotational motion that causes the member 312 to rotate to either raise or lower the tines 211 of the pair of adjustable tine sets 310.

Figure 17:
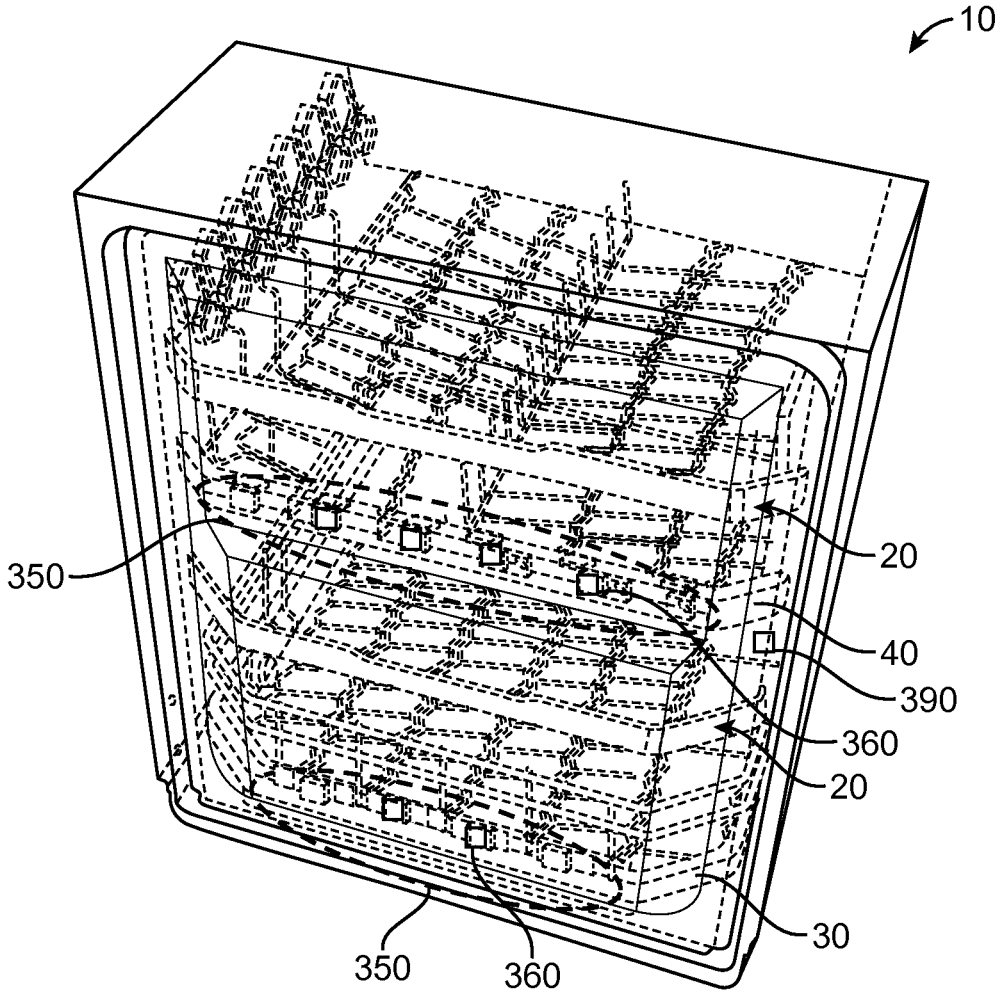
FIG. 17 illustrates an example sensor array for the dishwashing apparatus, in accordance with an embodiment of the invention.

FIG. 17 illustrates an example sensor array 350 for the dishwashing apparatus 10, in accordance with an embodiment of the invention. Each dish rack 20 has a corresponding sensor array 350. Each sensor array 350 has multiple sensors 360, wherein each sensor 360 corresponds to, and is positioned within proximity of, a slide adjuster 220/420 of a corresponding dish rack 20. The sensory arrays 350 may be positioned either at the front or the back of the dishwashing apparatus 10. For example, in one embodiment, each sensor array 350 is located within the door 5 of the apparatus 10.

Each sensor 360 is configured to detect a position (e.g., position A, B, AA or BB) that a corresponding slide adjuster 220/420 is set at. Detecting a position that a slide adjuster 220/420 is set at in turn allows for the position of a corresponding adjustable tine set 210/310 to be determined.

In one embodiment, the total number of sensors for each dish rack 20 is based on the total number of slide adjusters 220/420 coupled to the dish rack 20. For example, as shown in FIG. 17, four sensors 360 are used for the four slide adjusters 220 coupled to the upper dish rack 40, and two sensors 360 are used for the two slide adjusters 420 coupled to the lower dish rack 30. Further, if the lower dish rack 30 includes a utensil basket 70, the total number of sensors for the lower dish rack 30 is based on the total number of slide adjusters 420 coupled to the dish rack 20 plus one. For example, in FIG. 17, an additional sensor 390 positioned on an interior sidewall 11A of the housing 11 is used to detect the presence of a utensil basket 70.

In one embodiment, the sensors 360 of each sensor array 350 are a series of mechanical tact switches. In another embodiment, the sensors 360 of each sensor array 350 are a series of magnetic switches or other position detection mechanisms.

Figure 18:
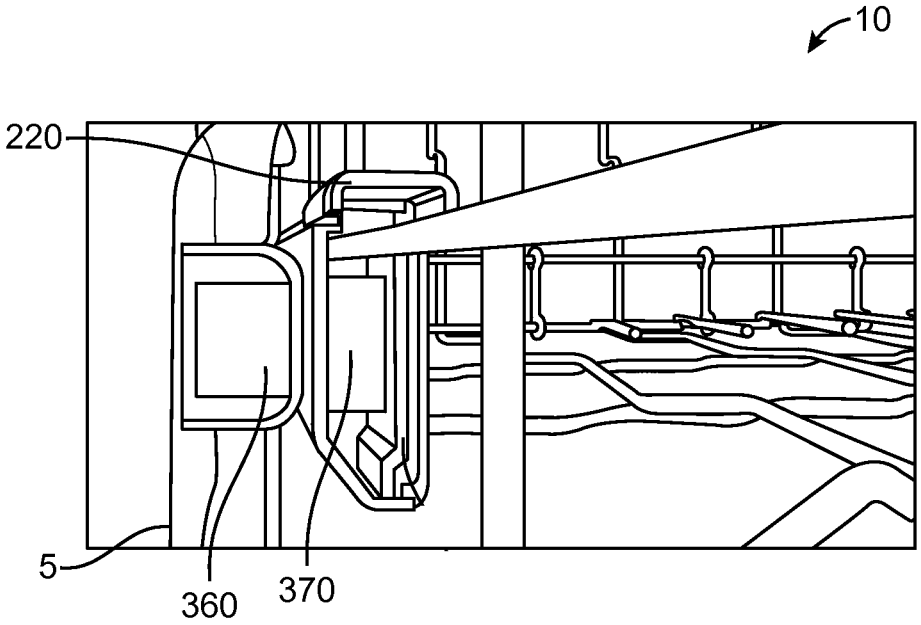
FIG. 18 illustrates a sensor and a corresponding slide adjuster, in accordance with an embodiment of the invention.

FIG. 18 illustrates a sensor 360 and a corresponding slide adjuster 220, in accordance with an embodiment of the invention. The sensor 360 is positioned within proximity of the slide adjuster 220. In one embodiment, a magnet 370 is embedded within the slide adjuster 220. The sensor 360 is a magnetic sensor that is triggered upon detecting that the magnet 370 is within its proximity. In another embodiment, the sensor 360 is a tactile switch, and the slide adjuster 220 is shaped such that the slide adjuster 220 triggers the sensor 360 when the slide adjuster 220 makes proximate contact with the sensor 360.

Figure 19:
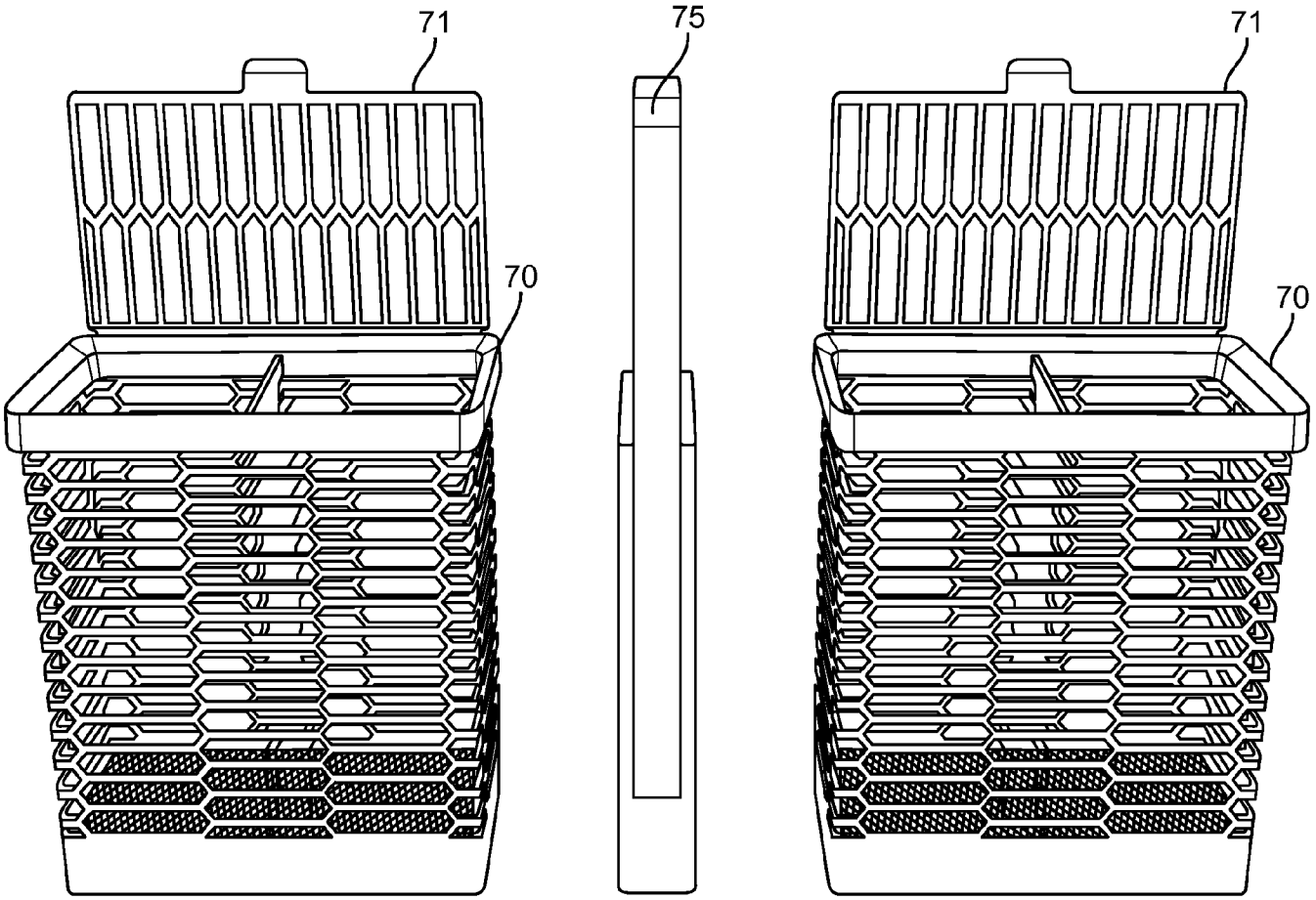
FIG. 19 illustrates the pair of utensil baskets, in accordance with an embodiment of the invention.

FIG. 19 illustrates the pair of utensil baskets 70, in accordance with an embodiment of the invention. Each utensil basket 70 has a corresponding lid 71 pivotally coupled to the utensil basket 70. The lids 71 may include various patterns of holes allowing for utensils to be loaded while each lid 71 is closed and to provide loading guidance with maximum spatial efficiency.

In one embodiment, elongated hexagonal patterns are used on the lids 71. Optionally, the patterns on the lids 71 may provide for staggered loading of utensils to assist in cleaning.

The utensil baskets 70 may be formed of plastic or other materials. In one embodiment, the utensil baskets 70 may comprise sensors (e.g., magnets or tact switches) detectable by embedded sensors within the interior cavity 15. Presence of the utensil baskets 70 may cause adjustments to a wash cycle (e.g., duration, detergent release, water pressure, etc.) for the zone that the utensils are located in.

Figure 20:
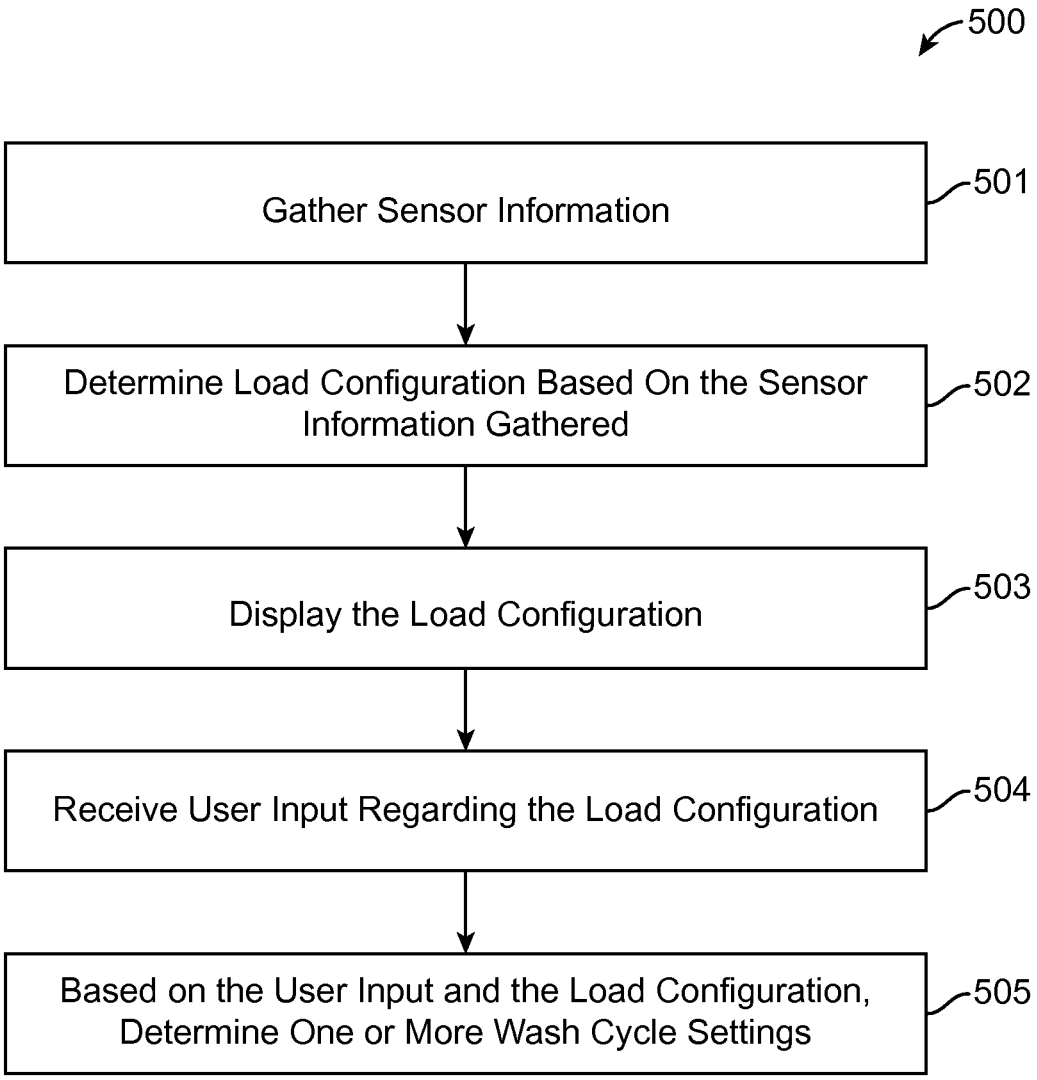
FIG. 20 illustrates an example flowchart for determining a customized wash cycle, in accordance with an embodiment of the invention.

FIG. 20 illustrates an example flowchart 500 for determining a customized wash cycle, in accordance with an embodiment of the invention. In process block 501, gather sensor information (e.g., sensor data from sensors 360 and/or 390). In process block 502, determine load configuration based on the sensor information gathered. In process block 503, display the load configuration (e.g., via the user interface 17). In process block 504, receive user input regarding the load configuration (e.g., receive user approval or user provided adjustments via the user interface 17). In process block 505, based on the user input and the load configuration, determine one or more wash cycle settings (i.e., parameters) to adjust for a customized wash cycle.

Figure 21:
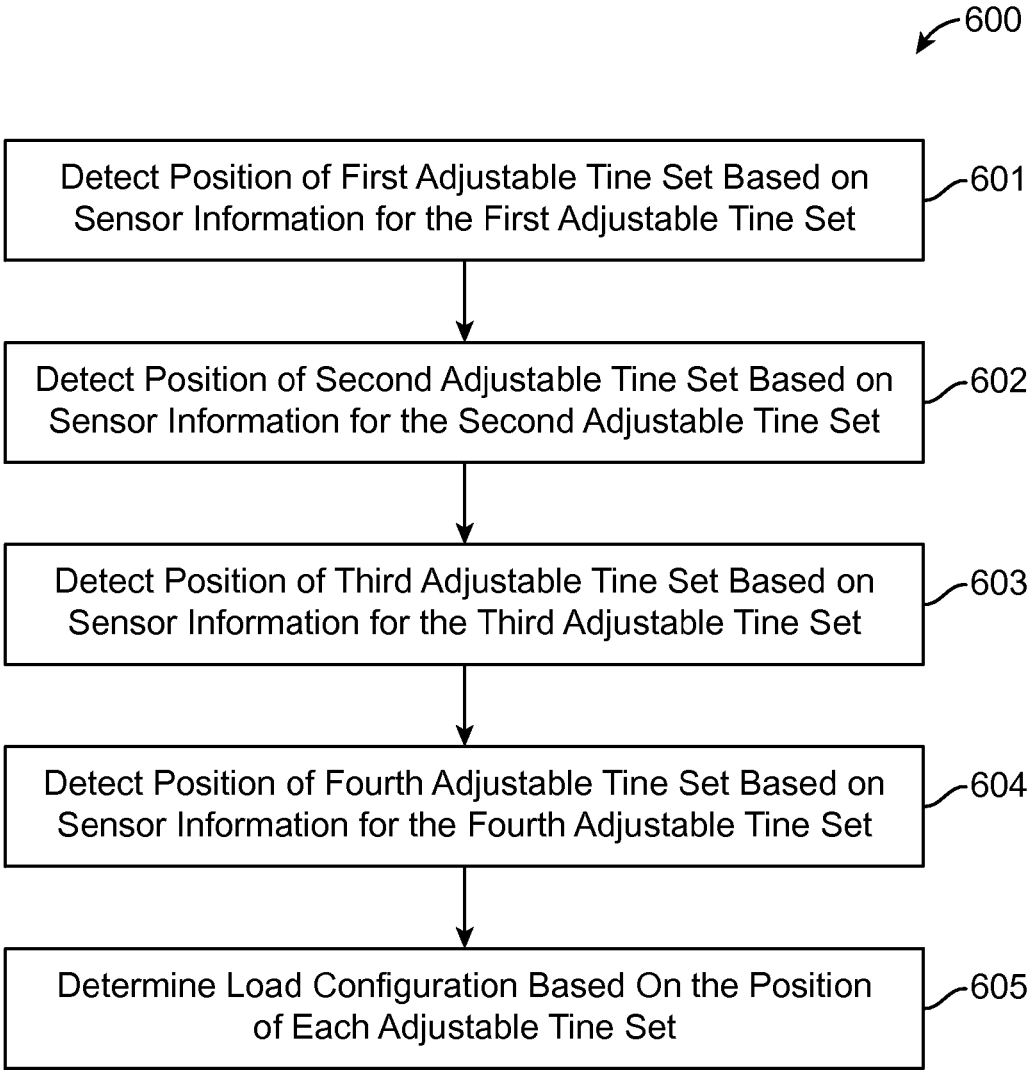
FIG. 21 illustrates an example flowchart for determining a load configuration for the upper dish rack, in accordance with an embodiment of the invention.

FIG. 21 illustrates an example flowchart 600 for determining a load configuration for the upper dish rack, in accordance with an embodiment of the invention. In process block 601, detect position of the first adjustable tine set based on sensor information gathered for the first adjustable tine set (e.g., sensor data from a sensor 360 within proximity of the first adjustable tine set 210). In process block 602, detect position of the second adjustable tine set based on sensor information gathered for the second adjustable tine set (e.g., sensor data from a sensor 360 within proximity of the second adjustable tine set 210). In process block 603, detect position of the third adjustable tine set based on sensor information gathered for the third adjustable tine set (e.g., sensor data from a sensor 360 within proximity of the third adjustable tine set 210). In process block 604, detect position of the fourth adjustable tine set based on sensor information gathered for the fourth adjustable tine set (e.g., sensor data from a sensor 360 within proximity of the fourth adjustable tine set 210). In process block 605, determine load configuration for the upper dish rack based on the position of each adjustable tine set.

FIG. 22 illustrates a table 700 providing example load configurations for the upper dish rack 40 based on the position of each adjustable tine set 210, in accordance with an embodiment of the invention. For example, if the first, second, third and fourth adjustable tine sets 210 are all raised to the substantially vertical position (as shown in FIG. 5), the load configuration unit 16 determines that dishes and bowls are loaded into each rack column 240 of the upper dish rack 40. The table 700 may be stored in memory.

Figure 23:
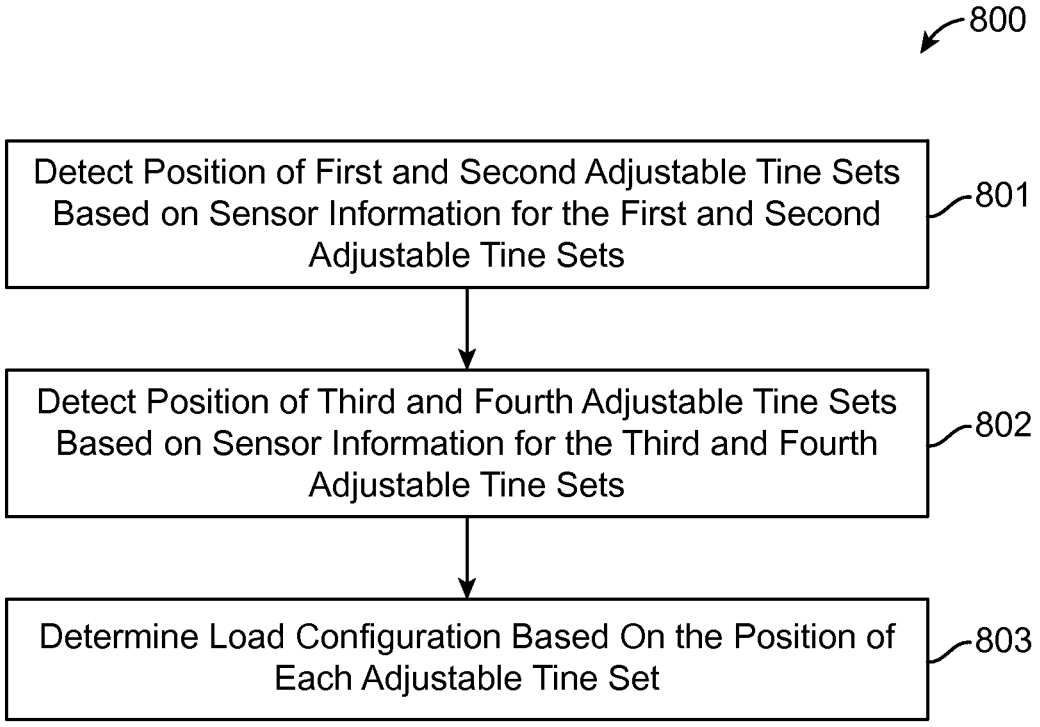
FIG. 23 illustrates an example flowchart for determining a load configuration for the lower dish rack, in accordance with an embodiment of the invention.

FIG. 23 illustrates an example flowchart 800 for determining a load configuration for the lower dish rack, in accordance with an embodiment of the invention. In process block 801, detect position of the first and second adjustable tine sets based on sensor information gathered for the first and second adjustable tine sets (e.g., sensor data from a sensor 360 within proximity of the first and second adjustable tine sets 310). In process block 802, detect position of the third and fourth adjustable tine sets based on sensor information gathered for the third and fourth adjustable tine sets (e.g., sensor data from a sensor 360 within proximity of the third and fourth adjustable tine sets 310). In process block 803, determine load configuration for the lower dish rack based on the position of each pair of adjustable tine sets.

FIG. 24 illustrates a table 900 providing example load configurations for the lower dish rack 30 based on the position of each adjustable tine set 310 and the presence of a utensil basket, in accordance with an embodiment of the invention. For example, if the first, second, third and fourth adjustable tine sets 210 are all raised to the substantially vertical position (as shown in FIG. 11) and a utensil basket is loaded into the lower dish rack 30, the load configuration unit 16 determines that, with the exception of the utensil basket in the sixth rack column 340, dishes are loaded between each remaining rack column 340 of the lower dish rack 30. The table 900 may be stored in memory.

Figure 25:
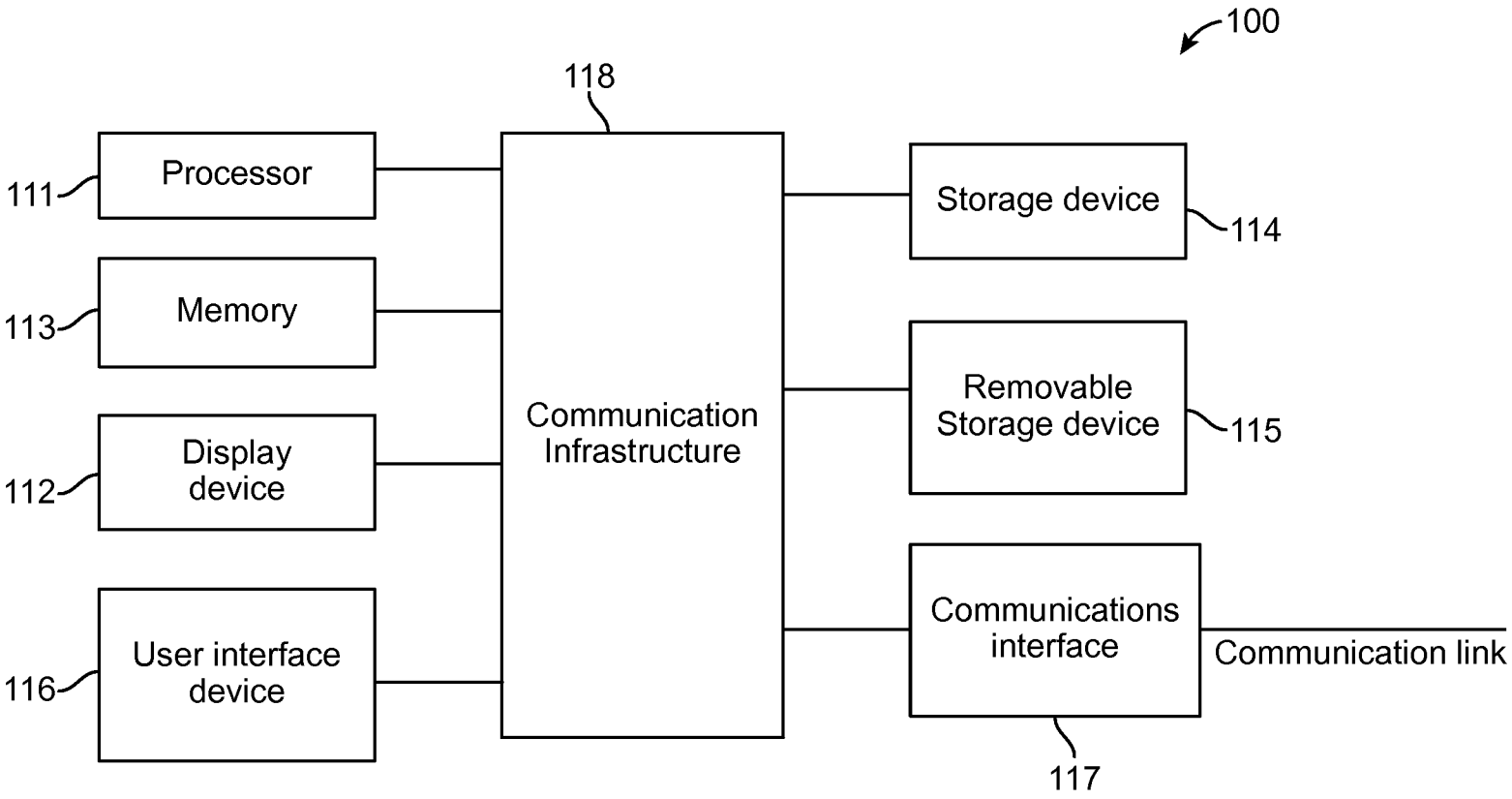
FIG. 25 is a high level block diagram showing an information processing system comprising a computer system useful for implementing an embodiment of the present invention.

FIG. 25 is a high level block diagram showing an information processing system comprising a computer system 100 useful for implementing an embodiment of the present invention. The computer system 100 includes one or more processors 111, and can further include an electronic display device 112 (for displaying graphics, text, and other data), a main memory 113 (e.g., random access memory (RAM)), storage device 114 (e.g., hard disk drive), removable storage device 115 (e.g., removable storage drive, removable memory unit, a magnetic tape drive, optical disk drive, computer readable medium having stored therein computer software and/or data), user interface device 116 (e.g., keyboard, touch screen, keypad, pointing device), and a communication interface 117 (e.g., modem, a network interface (such as an Ethernet card), a communications port, or a PCMCIA slot and card). The communication interface 117 allows software and data to be transferred between the computer system and external devices. The system 100 further includes a communications infrastructure 118 (e.g., a communications bus, network) to which the aforementioned devices/units 111 through 117 are connected.

Information transferred via communications interface 117 may be in the form of signals such as electronic, electromagnetic, optical, or other signals capable of being received by communications interface 117, via a communication link that carries signals and may be implemented using wire or cable, fiber optics, a phone line, a cellular phone link, an radio frequency (RF) link, and/or other communication channels. Computer program instructions representing the block diagram and/or flowcharts herein may be loaded onto a computer, programmable data processing apparatus, or processing devices to cause a series of operations performed thereon to produce a computer implemented process.

As is known to those skilled in the art, the aforementioned example architectures described above, according to said architectures, can be implemented in many ways, such as program instructions for execution by a processor, as software units, microcode, as computer program product on computer readable media, as analog/logic circuits, as application specific integrated circuits, as firmware, as consumer electronic devices, AV devices, wireless/wired transmitters, wireless/wired receivers, networks, multi-media devices, web servers, etc. Further, embodiments of said architecture can take the form of an entirely hardware embodiment, an entirely software embodiment or an embodiment containing both hardware and software elements.

One or more embodiments have been described with reference to flowchart illustrations and/or block diagrams of methods, apparatus (systems) and computer program products according to one or more embodiments. Each block of such illustrations/diagrams, or combinations thereof, can be implemented by computer program instructions. The computer program instructions when provided to a processor produce a machine, such that the instructions, which execute via the processor create means for implementing the functions/operations specified in the flowchart and/or block diagram. Each block in the flowchart/block diagrams may represent a hardware and/or software unit or logic, implementing one or more embodiments. In alternative implementations, the functions noted in the blocks may occur out of the order noted in the figures, concurrently, etc.

The terms "computer program medium," "computer usable medium," "computer readable medium", and "computer program product," are used to generally refer to media such as main memory, secondary memory, removable storage drive, a hard disk installed in hard disk drive. These computer program products are means for providing software to the computer system. The computer readable medium allows the computer system to read data, instructions, messages or message packets, and other computer readable information from the computer readable medium. The computer readable medium, for example, may include non-volatile memory, such as a floppy disk, ROM, flash memory, disk drive memory, a CD-ROM, and other permanent storage. It is useful, for example, for transporting information, such as data and computer instructions, between computer systems. Computer program instructions may be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

Computer program instructions representing the block diagram and/or flowcharts herein may be loaded onto a computer, programmable data processing apparatus, or processing devices to cause a series of operations performed thereon to produce a computer implemented process. Computer programs (i.e., computer control logic) are stored in main memory and/or secondary memory. Computer programs may also be received via a communications interface. Such computer programs, when executed, enable the computer system to perform the features of one or more embodiments as discussed herein. In particular, the computer programs, when executed, enable the processor and/or multicore processor to perform the features of the computer system. Such computer programs represent controllers of the computer system. A computer program product comprises a tangible storage medium readable by a computer system and storing instructions for execution by the computer system for performing a method of one or more embodiments.

Though the one or more embodiments have been described with reference to certain versions thereof; however, other versions are possible. Therefore, the spirit and scope of the appended claims should not be limited to the description of the preferred versions contained herein.

What is claimed is:

1. A method for adapting a wash cycle of a dishwashing machine, comprising:

gathering sensor information from one or more sensors of the dishwashing machine, wherein the sensor information gathered includes data identifying one or more adjustments to a rack layout of a dish rack of the dishwashing machine, the one or more sensors configured to detect a position of a slide adjuster of the dish rack, the slide adjuster coupled to an adjustable member of the dish rack, the adjustable member comprising an adjustable tine set, and the slide adjuster slidable along a portion of the dish rack to rotate the adjustable member to adjust the rack layout of the dish rack;

determining a load configuration for the dish rack based on the sensor information gathered, wherein the load configuration determined identifies one or more types of content loaded onto the dish rack; and adapting a wash cycle for washing the content loaded onto the dish rack based on the load configuration determined.

2. The method of claim 1, further comprising:

displaying the load configuration determined; and receiving user input regarding the load configuration determined;

wherein the wash cycle for the dish rack is further customized based on the user input received.

3. The method of claim 2, wherein the user input received includes one of: user confirmation for the load configuration determined, and an adjustment for the load configuration determined.

4. The method of claim 1, wherein adapting a wash cycle for the dish rack comprises adjusting one or more wash cycle parameters.

5. The method of claim 4, wherein the one or more wash cycle parameters include at least one of the following: amount of water pressure from a water nozzle of the dishwashing machine, a range of motion of a deflector blade of the dishwashing machine, the speed of the deflector blade, the duration of time the deflector blade is in motion, and the position of the deflector blade.

6. The method of claim 1, wherein:

the slide adjuster is coupled to the adjustable tine set of the dish rack, the adjustable tine set includes a plurality of tines, the slide adjuster is slidable back and forth along the portion of the dish rack to rotate the plurality of tines between varying positions, the varying positions include a substantially horizontal position where the plurality of tines lie flush against a bottom side of the dish rack, and the varying positions further include a substantially vertical position where the plurality of tines are positioned vertically relative to the bottom side of the dish rack.

7. A system for adapting a wash cycle of a dishwashing machine, comprising:

a sensor unit configured to gather sensor information from one or more sensors of the dishwashing machine, wherein the sensor information gathered includes data identifying one or more adjustments to a rack layout of a dish rack of the dishwashing machine, the one or more sensors configured to detect a position of a slide adjuster of the dish rack, the slide adjuster coupled to an adjustable member of the dish rack, the adjustable member comprising an adjustable tine set, and the slide adjuster slidable along a portion of the dish rack to rotate the adjustable member to adjust the rack layout of the dish rack;

a load configuration unit configured to determine a load configuration for the dish rack based on the sensor information gathered, wherein the load configuration determined identifies one or more types of content loaded onto the dish rack; and a wash cycle unit configured to adapt a wash cycle for washing the content loaded onto the dish rack based on the load configuration determined.

8. The system of claim 7, further comprising:

a user interface unit configured to:

display the load configuration determined; and receive user input regarding the load configuration determined;

wherein the wash cycle for the dish rack is further customized based on the user input received.

9. The system of claim 8, wherein the user input received includes one of: user confirmation for the load configuration determined, and an adjustment for the load configuration determined.

10. The system of claim 7, wherein adapting a wash cycle for the dish rack comprises adjusting one or more wash cycle parameters.

11. The system of claim 10, wherein the one or more wash cycle parameters include at least one of the following: amount of water pressure from a water nozzle of the dishwashing machine, a range of motion of a deflector blade of the dishwashing machine, the speed of the deflector blade, the duration of time the deflector blade is in motion, and the position of the deflector blade.

12. The system of claim 7, wherein:

the slide adjuster is coupled to an adjustable tine set of the dish rack, the adjustable tine set include a plurality of tines, the slide adjuster is slidable back and forth along the portion of the dish rack to rotate the plurality of tines between varying positions, the varying positions include a substantially horizontal position where the plurality of tines lie flush against a bottom side of the dish rack, and the varying positions further include a substantially vertical position where the plurality of tines are positioned vertically relative to the bottom side of the dish rack.

13. The system of claim 7, wherein:

the slide adjuster is coupled to the adjustable tine set; and the adjustable tine set includes a plurality of tines.

14. A non-transitory computer-readable storage medium having program code embodied therewith, the program code including instructions executable by a computer to perform a method comprising:

gathering sensor information from one or more sensors of a dishwashing machine, wherein the sensor information gathered includes data identifying one or more adjustments to a rack layout of a dish rack of the dishwashing machine, the one or more sensors configured to detect a position of a slide adjuster of the dish rack, the slide adjuster coupled to an adjustable member of the dish rack, the adjustable member comprising an adjustable tine set, and the slide adjuster slidable along a portion of the dish rack to rotate the adjustable member to adjust the rack layout of the dish rack;

determining a load configuration for the dish rack based on the sensor information gathered, wherein the load configuration determined identifies one or more types of content loaded onto the dish rack; and adapting a wash cycle for washing the content loaded onto the dish rack based on the load configuration determined.

15. The medium of claim 14, the method further comprising:

displaying the load configuration determined; and receiving user input regarding the load configuration determined;

wherein the wash cycle for the dish rack is further customized based on the user input received.

16. The medium of claim 15, wherein the user input received includes one of: user confirmation for the load configuration determined, and an adjustment for the load configuration determined.

17. The medium of claim 14, wherein adapting a wash cycle for the dish rack comprises adjusting one or more wash cycle parameters.

18. The medium of claim 17, wherein the one or more wash cycle parameters include at least one of the following: amount of water pressure from a water nozzle of the dishwashing machine, a range of motion of a deflector blade of the dishwashing machine, the speed of the deflector blade, the duration of time the deflector blade is in motion, and the position of the deflector blade.

19. The medium of claim 14, wherein:

the slide adjuster is coupled to the adjustable tine set of the dish rack, the adjustable tine set includes a plurality of tines, the slide adjuster is slidable back and forth along the portion of the dish rack to rotate the plurality of tines between varying positions, the varying positions include a substantially horizontal position where the plurality of tines lie flush against a bottom side of the dish rack, and the varying positions further include a substantially vertical position where the plurality of tines are positioned vertically relative to the bottom side of the dish rack.

20. A dishwashing apparatus, comprising:

a dish rack including an adjustable tine set configured to adjust a rack layout of the dish rack;

one or more sensors configured to capture sensor information including data identifying one or more adjustments to the rack layout of the dish rack, the one or more sensors further configured to detect a position of a slide adjuster coupled to the adjustable tine set, and the slide adjuster slidable along a portion of the dish rack to rotate the adjustable tine set;

a load configuration unit configured to determine a load configuration for the dish rack based on the sensor information captured, wherein the load configuration determined identifies one or more types of content loaded onto the dish rack; and a wash cycle unit configured to adapt a wash cycle for washing the content loaded onto the dish rack based on the load configuration determined.

21. The apparatus of claim 20, further comprising:

a user interface unit configured to:

display the load configuration determined; and receive user input regarding the load configuration determined;

wherein the wash cycle for the dish rack is further customized based on the user input received.

22. The apparatus of claim 21, wherein the user input received includes one of: user confirmation for the load configuration determined, and an adjustment for the load configuration determined.

23. The apparatus of claim 20, wherein the wash cycle unit is further configured to adjust one or more wash cycle parameters to customize a wash cycle for washing the content loaded onto the dish rack.

24. The apparatus of claim 23, wherein the one or more wash cycle parameters include at least one of the following: amount of water pressure from a water nozzle of the dishwashing machine, a range of motion of a deflector blade of the dishwashing machine, the speed of the deflector blade, the duration of time the deflector blade is in motion, and the position of the deflector blade.

25. The apparatus of claim 20, wherein:

the adjustable tine set includes a plurality of tines, the slide adjuster is slidable back and forth along the portion of the dish rack to rotate the plurality of tines between varying positions, the varying positions include a substantially horizontal position where the plurality of tines lie flush against a bottom side of the dish rack, and the varying positions further include a substantially vertical position where the plurality of tines are positioned vertically relative to the bottom side of the dish rack.

26. A dishwashing apparatus, comprising:

a dish rack including a dish rack frame with a customizable rack layout;

one or more rack layout adjustment devices facilitating one or more manual adjustments to the rack layout; and at least one sensor device configured to capture sensor data identifying one or more manual adjustments to the rack layout, wherein each sensor device is positioned within proximity of a rack layout adjustment device, the sensor device further configured to detect a position of a slide adjuster of the rack layout adjustment device, the slide adjuster coupled to an adjustable member of the dish rack, the adjustable member comprising an adjustable tine set, and the slide adjuster slidable along a portion of the dish rack frame to rotate the adjustable member to adjust the rack layout.

27. The apparatus of claim 26, wherein:

the dish rack frame further includes a guide track;

each rack layout adjustment device further comprises the adjustable member, the adjustable member including a rotatable set of tines that is pivotally coupled to the dish rack frame; and the slide adjuster is slidably coupled to the guide track and interconnected with the tines, and the slide adjuster is movable back and forth along a portion of the guide track to rotate the tines between varying positions including a substantially horizontal position where the tines lie flush against a bottom side of the dish rack and a substantially vertical position where the tines are positioned vertically relative to the bottom side of the dish rack, thereby adjusting the rack layout.

28. The apparatus of claim 27, wherein:

each rack layout adjustment device further comprises:

a rotatable member that is coupled to each tine of the rack layout adjustment device; and a connection mechanism interconnecting the rotatable member with the slide adjuster of the rack layout adjustment device, wherein the connection mechanism triggers the rotatable member to rotate the tines between the varying positions when the slide adjuster is moved back and forth along a portion of the guide track.

29. The apparatus of claim 26, wherein:

the dish rack frame further includes a guide track;

each rack layout adjustment device further comprises the adjustable member, the adjustable member including:

a first rotatable set of tines that is pivotally coupled to the dish rack frame; and a second rotatable set of tines that is pivotally coupled to the dish rack frame; and the slide adjuster is slidably coupled to the guide track and interconnected with both the first and the second sets of tines, and the slide adjuster is movable back and forth along a portion of the guide track to simultaneously rotate the first and the second sets of tines between varying positions including a substantially horizontal position where the tines lie flush against a bottom side of the dish rack and a substantially vertical position where the tines are positioned vertically relative to the bottom side of the dish rack, thereby adjusting the rack layout.

30. The apparatus of claim 29, wherein:

each rack layout adjustment device further comprises:

a first rotatable member that is coupled to each tine of the first set of tines of the rack layout adjustment device;

a second rotatable member that is coupled to each tine of the second set of tines of the rack layout adjustment device; and a connection mechanism interconnecting both the first and the second rotatable members with the slide adjuster of the rack layout adjustment device, wherein the connection mechanism triggers the first and the second rotatable members to simultaneously rotate the first and the second sets of tines between the varying positions when the slide adjuster is moved back and forth along a portion of the guide track.

31. The apparatus of claim 26, wherein:

the dish rack frame further includes:

one or more rotatable flip shelves pivotally coupled to the dish rack frame, wherein each flip shelf is rotatable to further adjust the rack layout.

32. The apparatus of claim 26, further comprising:

one or more removable utensil baskets; and at least one additional sensor device for capturing sensor data indicating whether a utensil basket is inserted into the dish rack.

* * * * *